US008100715B2

(12) United States Patent
Whitlock et al.

(10) Patent No.: US 8,100,715 B2
(45) Date of Patent: Jan. 24, 2012

(54) RCA-COMPATIBLE CONNECTORS FOR BALANCED AND UNBALANCED INTERFACES

(75) Inventors: William E. Whitlock, Oxnard, CA (US); James A. Concorso, Bridgewater, NJ (US)

(73) Assignee: William E. Whitlock, Oxnard, CA (US)

( * ) Notice: Subject to any disclaimer, the term of this patent is extended or adjusted under 35 U.S.C. 154(b) by 0 days.

(21) Appl. No.: 12/753,258

(22) Filed: Apr. 2, 2010

(65) Prior Publication Data

US 2011/0244724 A1 Oct. 6, 2011

(51) Int. Cl.
*H01R 9/05* (2006.01)

(52) U.S. Cl. ..... 439/580; 439/675

(58) Field of Classification Search ..... 439/580, 439/583, 585, 848, 675, 351, 282, 63
See application file for complete search history.

(56) References Cited

U.S. PATENT DOCUMENTS

| | | | | | |
|---|---|---|---|---|---|
| 3,144,292 | A | | 8/1964 | Fomey, Jr. | |
| 3,193,636 | A | | 7/1965 | Daniels | |
| 3,258,735 | A | | 6/1966 | Valle | |
| 3,429,041 | A | | 2/1969 | Patton, Jr. | |
| 3,474,386 | A | * | 10/1969 | Link | 439/181 |
| 3,521,216 | A | | 7/1970 | Tolegian | |
| 3,613,050 | A | * | 10/1971 | Andrews | 439/580 |
| 3,978,581 | A | | 9/1976 | Miura | |
| 4,129,352 | A | | 12/1978 | Iizuka | |
| 4,307,926 | A | * | 12/1981 | Smith | 439/607.52 |
| 4,431,254 | A | | 2/1984 | Cartesse | |
| 4,593,464 | A | * | 6/1986 | Williams et al. | 29/879 |
| 4,630,876 | A | | 12/1986 | Grunberg | |
| 4,736,999 | A | | 4/1988 | Marks | |
| 4,799,902 | A | * | 1/1989 | Laudig et al. | 439/585 |
| 4,869,690 | A | | 9/1989 | Frear | |
| 4,976,632 | A | * | 12/1990 | Riches et al. | 439/580 |
| 4,995,836 | A | | 2/1991 | Toramoto | |
| 5,312,271 | A | | 5/1994 | Matsumoto | |
| 5,568,561 | A | | 10/1996 | Whitlock | |
| 5,605,468 | A | * | 2/1997 | Wood | 439/282 |
| 5,676,565 | A | | 10/1997 | Vagnoni | |
| 5,885,104 | A | * | 3/1999 | Foster et al. | 439/580 |
| 6,695,644 | B2 | * | 2/2004 | Zhao et al. | 439/580 |
| 6,869,316 | B2 | * | 3/2005 | Hinkle et al. | 439/675 |
| 6,981,895 | B2 | * | 1/2006 | Potega | 439/578 |
| 7,195,505 | B1 | * | 3/2007 | Becker | 439/282 |
| 7,458,853 | B2 | * | 12/2008 | Omura et al. | 439/607.01 |
| 7,651,344 | B2 | * | 1/2010 | Wu | 439/80 |
| 7,727,029 | B2 | * | 6/2010 | Bolin et al. | 439/669 |
| 2010/0105226 | A1 | * | 4/2010 | Gong et al. | 439/135 |
| 2010/0311280 | A1 | * | 12/2010 | Tin et al. | 439/675 |

* cited by examiner

*Primary Examiner* — Hae Moon Hyeon
(74) *Attorney, Agent, or Firm* — Lyon & Harr, LLP; Richard T. Lyon

(57) ABSTRACT

A socket connector includes a conductive center receptacle, first outer socket contact having a first socket contact surface, second outer socket contact having a second socket contact surface, and non-conductive socket body. The socket contact surfaces are separated longitudinally along an axis of the receptacle. The socket body maintains the socket contacts electrically isolated from each other and the receptacle whenever the socket connector is not mated with a bi-conducting plug connector. A plug connector includes a conductive center pin, first outer plug contact having a first plug contact surface, second outer plug contact having a second plug contact surface, annular insulator, and non-conductive plug body. The plug contact surfaces are separated longitudinally along an axis of the pin. The plug body and insulator maintain the plug contacts electrically isolated from each other and the pin whenever the plug connector is not mated with a bi-conducting socket connector.

23 Claims, 13 Drawing Sheets

RCA-COMPATIBLE CONNECTORS FOR BALANCED AND UNBALANCED INTERFACES

BACKGROUND

A predicable amount of "white noise" (also known as "random noise") inherently exists in all electronic equipment. In an audio system this noise sounds like a waterfall or the hiss of an FM (frequency modulation) radio tuned between stations. In a video system this noise appears as grainy movement or "snow" in the image. White noise cannot be prevented or removed without altering the original signal. "Interference" is another type of electrical signal contamination which arises from extraneous sources such as AC (alternating current) power lines and ambient electromagnetic fields such as radio and television signals. Interference typically contaminates an electrical signal by coupling with the signal at the interface between separate pieces of electronic equipment. In audio systems interference can cause audible hum, buzz, clicks, pops and other degradations of the audio. In video systems interference can cause hum bars, specks and other degradations of the image.

An interface between two pieces of electronic equipment generally includes both physical and electrical characteristics. More particularly, such an interface includes line driver circuitry and an output connector at the source electronic equipment, an input connector and line receiver circuitry at the destination electronic equipment, and a cable which runs between the output connector and the input connector. One end of the cable includes a first cable connector which mates with the output connector, and the other end of the cable includes a second cable connector which mates with the input connector. To a large extent, the immunity of an interface to interference is determined by the interface type. Two types of interfaces that are used in consumer electronic equipment today are balanced interfaces and unbalanced interfaces. Coaxial connectors, commonly known as "RCA" connectors and sometimes also referred to as Institute of High Fidelity (IHF) connectors, are the de facto standard type of connectors employed today to carry audio and video electrical signals between consumer electronic equipment. The name "RCA" derives from the Radio Corporation of America, which introduced the original RCA connector design in the early 1940s.

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter.

RCA-compatible connector embodiments described herein generally involve a tri-conducting, RCA-compatible socket connector and a tri-conducting, RCA-compatible plug connector. An exemplary embodiment of the tri-conducting, RCA-compatible socket connector includes an electrically conductive center receptacle, an electrically conductive first outer socket contact, an electrically conductive second outer socket contact, and an electrically non-conductive socket body. The first outer socket contact includes a first socket contact surface which is radially disposed a first distance from a longitudinal axis of the center receptacle, where the first socket contact surface is an outer surface of the first outer socket contact. The second outer socket contact includes a second socket contact surface which is radially disposed an approximately equal distance from the receptacle's axis as the first socket contact surface, where the second socket contact surface is an outer surface of the second outer socket contact. The first and second socket contact surfaces are separated longitudinally from each other along the receptacle's axis. The socket body maintains the first and second outer socket contacts electrically isolated from each other and from the center receptacle whenever the socket connector is not mated with a bi-conducting plug connector.

An exemplary embodiment of the tri-conducting, RCA-compatible plug connector includes an electrically conductive center pin, an electrically conductive first outer plug contact, an electrically conductive second outer plug contact, an electrically non-conductive plug body, and an annular insulator. The first outer plug contact includes a first plug contact surface which is radially disposed the first distance from a longitudinal axis of the center pin. The second outer plug contact includes a second plug contact surface which is radially disposed an approximately equal distance from the pin's axis as the first plug contact surface. The first and second plug contact surfaces are separated longitudinally from each other along the pin's axis. The annular insulator is radially disposed in-between the first and second plug contact surfaces. The plug body and annular insulator maintain the first and second outer plug contacts electrically isolated from each other and from the center pin whenever the plug connector is not mated with a bi-conducting socket connector.

DESCRIPTION OF THE DRAWINGS

The specific features, aspects, and advantages of the RCA-compatible connector embodiments described herein will become better understood with regard to the following description, appended claims, and accompanying drawings where:

DETAILED DESCRIPTION

Figure 1:
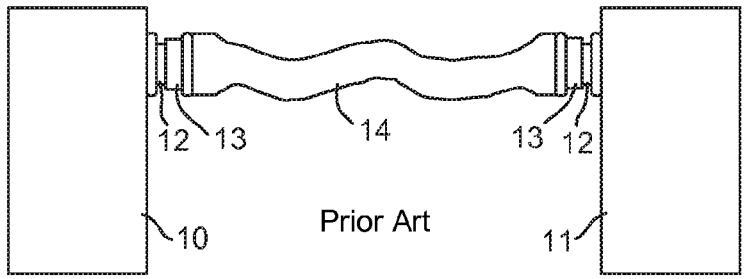
FIG. 1 is a diagram illustrating a side view of an exemplary embodiment of a conventional interface between two pieces of consumer electronic equipment.
Figure 2A:
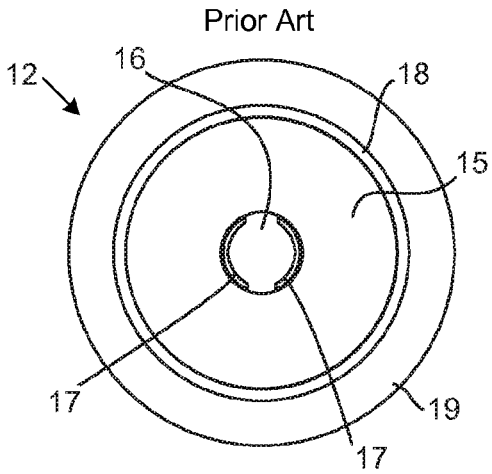
FIG. 2A is a diagram illustrating a front view of an exemplary embodiment of a conventional, bi-conducting RCA socket connector
Figure 2B:
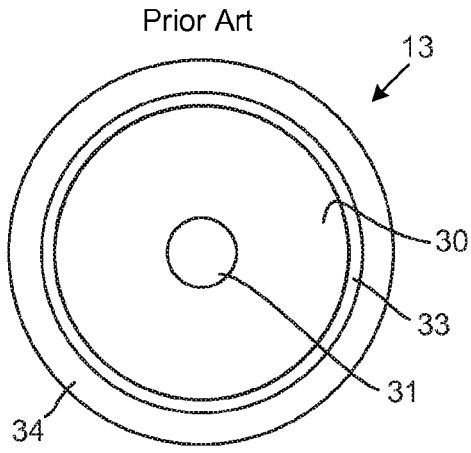
FIG. 2B is a diagram illustrating a front view of an exemplary embodiment of a conventional, bi-conducting RCA plug connector.
Figure 3A:
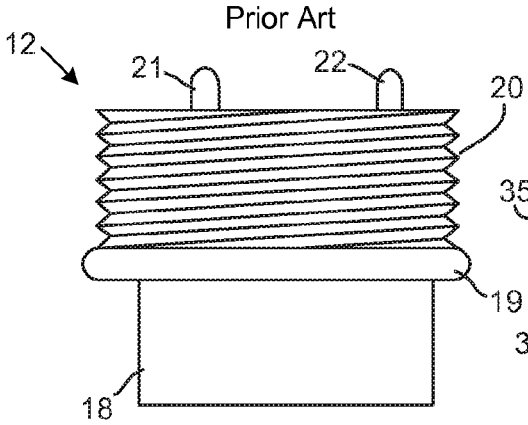
FIG. 3A is a diagram illustrating a side view of the socket connector of FIG. 2A
Figure 3B:
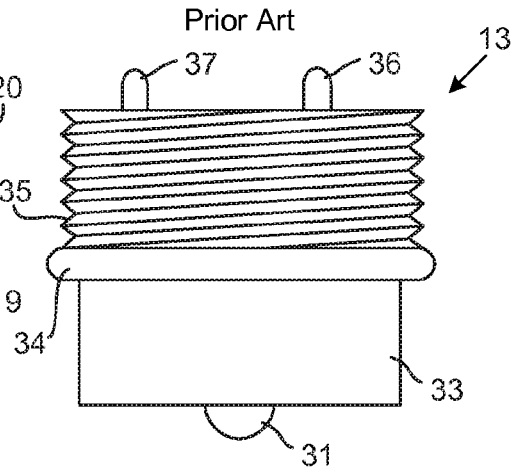
FIG. 3B is a diagram illustrating a side view of the plug connector of FIG. 2B.
Figure 4A:
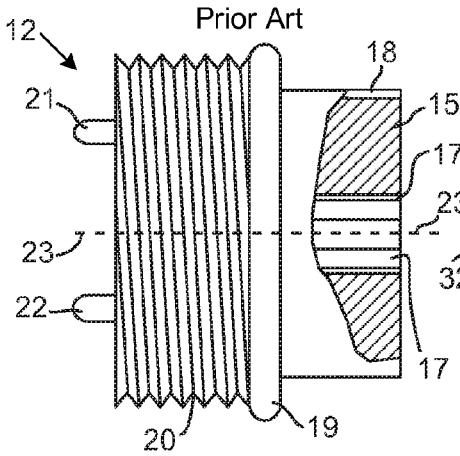
FIG. 4A is a diagram illustrating a partially sectioned side view of the socket connector of FIG. 3A rotated counter-clockwise 90 degrees and FIG. 4B is a diagram illustrating a partially sectioned side view of the plug connector of FIG. 3B rotated clockwise 90 degrees.
Figure 4B:
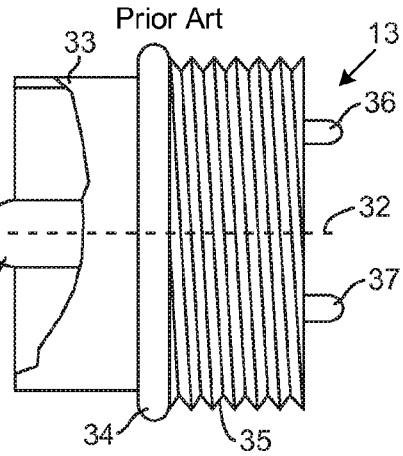

In the following description of RCA-compatible connector embodiments reference is made to the accompanying drawings which form a part hereof, and in which are shown, by way of illustration, specific embodiments in which the RCA-compatible connectors can be practiced. It is understood that other embodiments can be utilized and structural changes can be made without departing from the scope of the RCA-compatible connector embodiments.

The term "bi-conducting socket connector" is used herein to refer to a socket connector having two separate conductors. The term "bi-conducting RCA socket connector" is used herein to refer to an RCA-type socket connector having two separate conductors. The term "bi-conducting plug connector" is used herein to refer to a plug connector having two separate conductors. The term "bi-conducting RCA plug connector" is used herein to refer to an RCA-type plug connector having two separate conductors. The term "tri-conducting socket connector" is used herein to refer to a socket connector having three separate conductors. The term "tri-conducting plug connector" is used herein to refer to a plug connector having three separate conductors.

1.0 Electrical Signal Interfaces

As described heretofore, balanced interfaces and unbalanced interfaces are two types of interfaces that are used in consumer electronic equipment today. Both types of interfaces use a pair of signal conductors (i.e., a first signal conductor and a second signal conductor) to carry an electrical signal between two pieces of electronic equipment. A principal difference between balanced and unbalanced interfaces is the impedance of their signal conductors to ground.

In an unbalanced interface the first signal conductor is grounded so its impedance to ground is effectively zero, and the second signal conductor has a significant impedance to ground. Thus, the term "unbalanced" is used to described this type of interface. Power line interference is coupled from a power line to the ground in each of the two pieces of electronic equipment through its power transformer. As a result, interference current flows in the grounded first signal conductor of an unbalanced interface, thereby creating "ground noise" voltages between the equipment grounds of the two pieces of electronic equipment. Power line interference current flowing in the grounded first signal conductor causes a voltage drop in this conductor that is directly added to the signal being carried by the unbalanced interface. This coupling of interference with the grounded first signal conductor is referred to as "common-impedance coupling." An unbalanced interface is also susceptible to the interference effects of (i.e., the induced interference voltage pickup from) power lines, magnetic fields and electrostatic fields.

In a balanced interface both the first and second signal conductors have a significant impedance to ground, where these two impedances are nominally equal. The line receiver of a balanced interface (hereafter referred to as a "balanced line receiver") employs a differential device such as a differential amplifier, a transformer, or the like, where the differential device inherently produces an output having an amplitude that is proportional to the voltage difference between the first and second signal conductors. Since the impedance to ground for the first and second signal conductors is nominally equal, the first and second signal conductors receive nominally equal interference voltages. Thus, the balanced line receiver will have a nominally equal interference voltage on both of its inputs and the interference will produce no output from the balanced line receiver since the interference will be subtracted out by the receiver (i.e., the interference will be rejected by the receiver). Thus, a balanced interface will generally reject the interference effects of power lines, magnetic fields and electrostatic fields.

A balanced interface can also optionally include a third conductor that connects the ground of the source electronic equipment to the ground of the destination electronic equipment. The first signal conductor in a balanced interface is also referred to hereafter as a "high signal conductor." The second signal conductor in a balanced interface is also referred to hereafter as a "low signal conductor." The optional third conductor in a balanced interface is also referred to hereafter as both a "shield," and a "ground conductor."

Given the foregoing, and as is appreciated in the art of electronics, an unbalanced interface is much more susceptible to interference than a balanced interface. Nonetheless, unbalanced interfaces have been widely used in consumer electronic equipment. This is because the connectors that have been commonly used for balanced interfaces (such as XLR-3 connectors and the like) are much larger and more expensive than the aforementioned RCA connectors that have been commonly used for unbalanced interfaces. As will be appreciated from the more detailed description of conventional, bi-conducting RCA connectors which follows, since these connectors support only two conductors they cannot be used in a typical balanced interface.

FIG. 1 illustrates a side view of an exemplary embodiment of a conventional interface between two pieces of consumer electronic equipment. Generally speaking and as exemplified in FIG. 1, a piece of source electronic equipment 10 (hereafter simply referred to as "source equipment") generates an electrical signal (not shown) which is transmitted to a piece of destination electronic equipment 11 (hereafter simply referred to as "destination equipment") by an interface. In other words, the source equipment 10 operates as the signal driving equipment and the destination equipment 11 operates as the signal receiving equipment.

Referring again to FIG. 1, the interface between the source and destination equipment 10 and 11 includes the following components. A first bi-conducting RCA socket connector 12 is physically mounted on the source equipment 10, and is electrically connected to a line driver (not shown) in the source equipment. A second bi-conducting RCA socket connector 12 is physically mounted on the destination equipment 11, and is electrically connected to a line receiver (not shown) in the destination equipment. A first bi-conducting RCA plug connector 13 is physically mounted on and electrically connected to one end of a two-conductor cable such as a conventional coaxial cable 14 and the like. A second bi-conducting RCA plug connector 13 is physically mounted on and electrically connected to the other end of the cable 14. The manner in which these electrical connections are made will be described in more detail hereafter. The first RCA plug connector 13 is plugged into the first RCA socket connector 12 on the source equipment 10, and the second RCA plug connector 13 is plugged into the second RCA socket connector 12 on the destination equipment 11. Those skilled in the art of electronics sometimes refer to a socket connector as a "jack" or "female" connector, and sometimes refer to a plug connector as a "pin," or "male," or "pin plug" connector.

Figure 5:
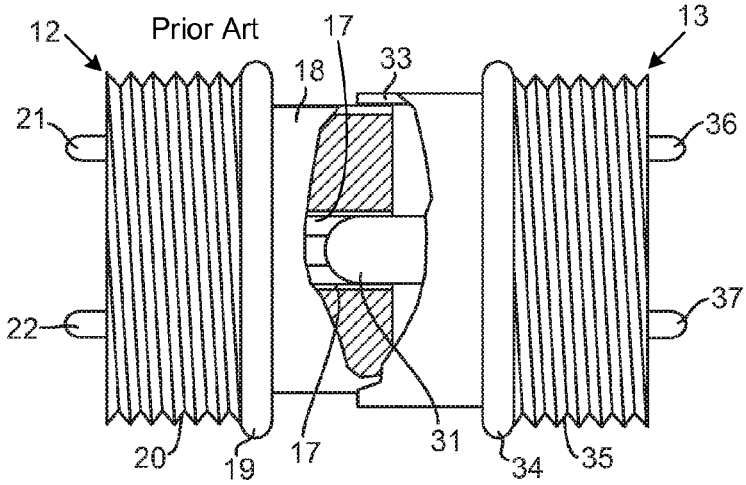
FIG. 5 is a diagram illustrating a partially sectioned side view of the socket connector of FIG. 4A and the plug connector of FIG. 4B mated together.
Figure 6:
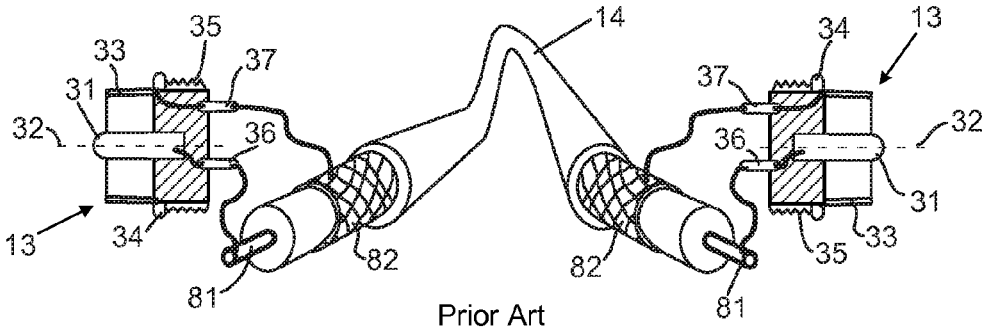
FIG. 6 is a diagram illustrating a partially sectioned, partially cut-away and partially exploded side view of an exemplary embodiment of a conventional coaxial cable and its connections to a first bi-conducting RCA plug connector on one end of the cable and a second bi-conducting RCA plug connector on the other end of the cable.
Figure 7A:
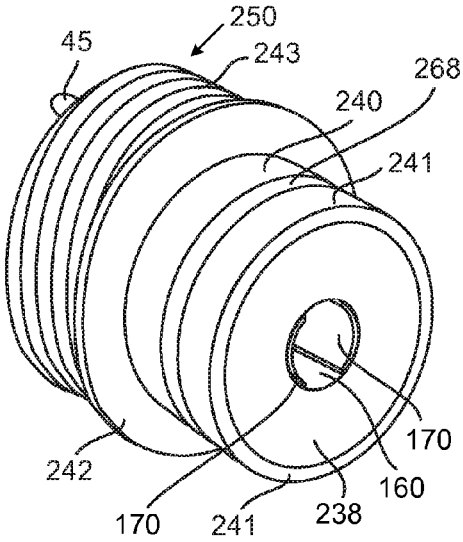
FIG. 7A is a diagram illustrating a perspective view of one embodiment of a tri-conducting, RCA-compatible socket connector
Figure 7B:
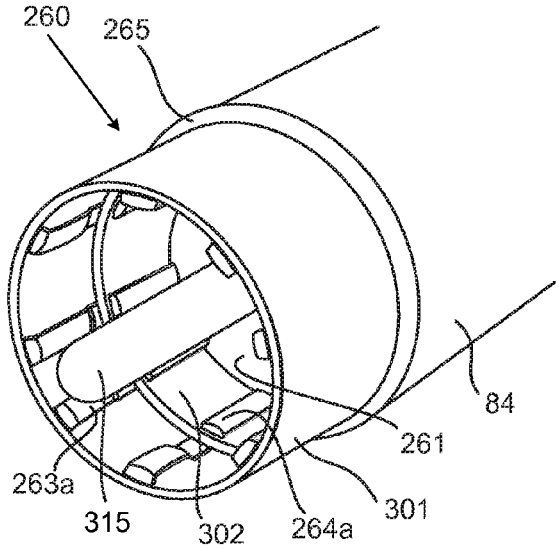
FIG. 7B is a diagram illustrating a perspective view of one embodiment of a tri-conducting, RCA-compatible plug connector.
Figure 8A:
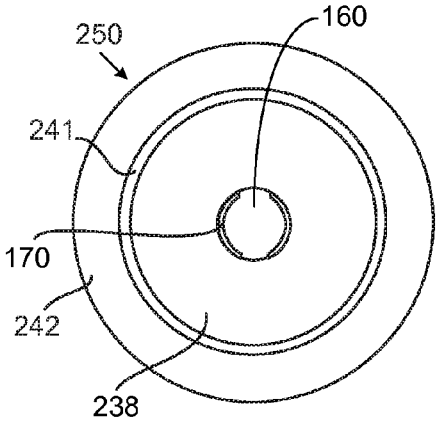
FIG. 8A is a diagram illustrating a front view of the socket connector of FIG. 7A
Figure 8B:
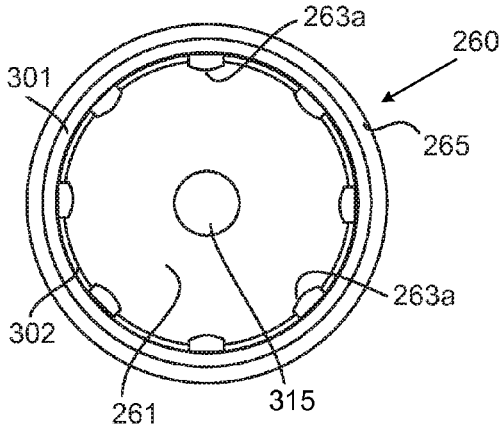
FIG. 8B is a diagram illustrating a front view of the plug connector of FIG. 7B.
Figure 9A:
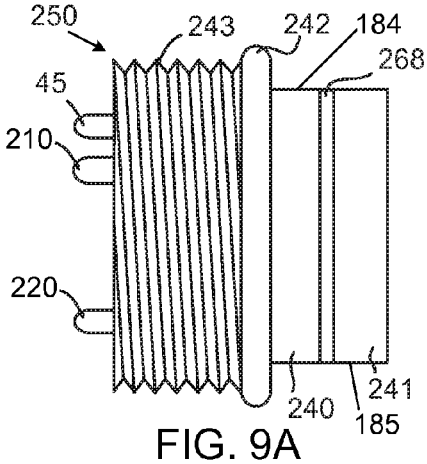
FIG. 9A is a diagram illustrating one side view of the socket connector of FIG. 7A
Figure 9B:
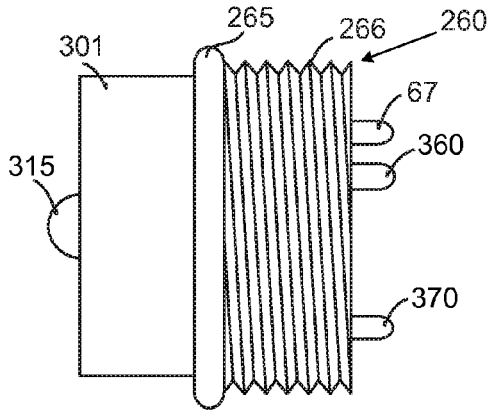
FIG. 9B is a diagram illustrating one side view of the plug connector of FIG. 7B, where the socket and plug connectors are facing each other.
Figure 10A:
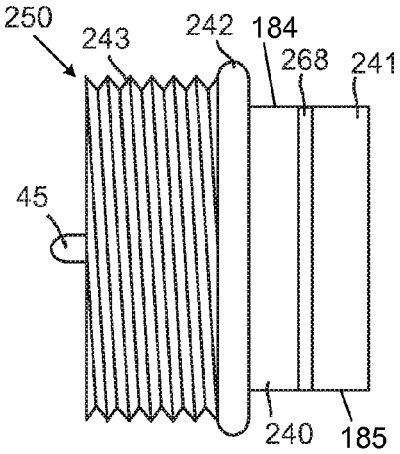
FIG. 10A is a diagram illustrating another side view of the socket connector of FIG. 7A
Figure 10B:
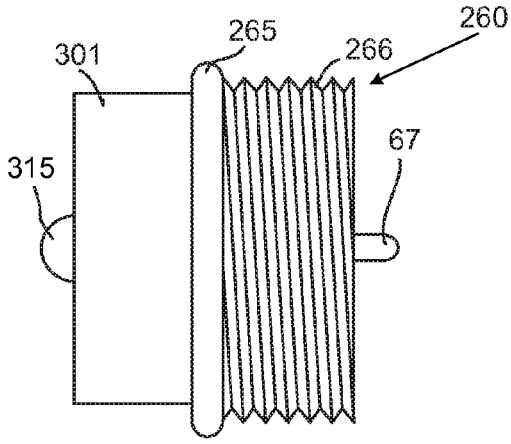
FIG. 10B is a diagram illustrating another side view of the plug connector of FIG. 7B, where the socket and plug connectors are facing each other.

Generally speaking, FIGS. 2-6 illustrate an exemplary embodiment of the construction of a conventional, bi-conducting RCA socket connector and an exemplary embodiment of the construction of a conventional, bi-conducting RCA plug connector. More particularly, FIG. 2A illustrates a front view of an exemplary embodiment of a conventional, bi-conducting RCA socket connector and FIG. 2B illustrates a front view of an exemplary embodiment of a conventional, bi-conducting RCA plug connector. FIG. 3A illustrates a side view of the socket connector of FIG. 2A and FIG. 3B illustrates a side view of the plug connector of FIG. 2B. FIG. 4A illustrates a partially sectioned side view of the socket connector of FIG. 3A rotated counter-clockwise 90 degrees and FIG. 4B illustrates a partially sectioned side view of the plug connector of FIG. 3B rotated clockwise 90 degrees. FIG. 5 illustrates a partially sectioned side view of the socket connector of FIG. 4A and the plug connector of FIG. 4B mated together. FIG. 6 illustrates a partially sectioned, partially cutaway and partially exploded side view of an exemplary embodiment of a conventional coaxial cable and its connections to a first bi-conducting RCA plug connector on one end of the cable and a second bi-conducting RCA plug connector on the other end of the cable.

As exemplified in FIGS. 2A-4A, the bi-conducting RCA socket connector 12 is typically constructed as follows. The socket connector 12 includes an electrically non-conductive (i.e., "insulative") socket body 15, an electrically conductive center receptacle 16, an electrically conductive outer cylindrical surface 18 (also referred to herein as an outer socket contact 18), and a first annular mounting flange 19. The socket body 15 typically has a cylindrical shape. The center receptacle 16 has a longitudinal axis 23 (shown as a dashed line in FIG. 4A) which is usually coincident with the longitudinal axis of the socket body 15. The center receptacle 16 includes a cavity (i.e., a void) typically having a circular cross-section formed in the socket body 15, and one or more electrically conductive central contacts 17 which are placed adjacent the periphery of the cavity. The outer socket contact 18 radially surrounds the socket body 15. The mounting flange 19 includes mounting threads 20 which are used to affix the socket connector 12 to a mounting panel (not shown) on the aforementioned source and destination electronic equipment 10 and 11. The mounting flange 19 and its threads 20 are typically electrically conductive and electrically connected to the outer socket contact 18. Whenever the mounting panel on the equipment 10 and 11 is electrically conductive, the mounting flange 19, its threads 20 and the mounting panel on the equipment provide a first electrical connection between the outer socket contact 18 and circuitry (not shown) in the equipment.

As further exemplified in FIGS. 2A-4A and referring again to FIG. 1, the bi-conducting RCA socket connector 12 further includes a center socket contact terminal 21 which is electrically connected to at least one of the electrically conductive central contacts 17 of the center receptacle 16. The center socket contact terminal 21 provides a second electrical connection to circuitry in the electronic equipment 10 and 11. The socket connector 12 can optionally yet further include an outer socket contact terminal 22 which is electrically connected to the outer socket contact 18. The outer socket contact terminal 22 may be used to provide a third electrical connection to circuitry in the equipment 10 and 11, particularly whenever the mounting panel is electrically non-conductive.

As exemplified in FIGS. 2B-4B, the bi-conducting RCA plug connector 13 is typically constructed as follows. The plug connector 13 includes an electrically non-conductive (i.e., insulative) plug body 30, an electrically conductive center pin 31, an electrically conductive outer plug contact 33, and a second annular mounting flange 34. The plug body 30 typically has a cylindrical shape. The center pin 31 has a longitudinal axis 32 (shown as a dashed line in FIG. 4B) which is usually coincident with the longitudinal axis of the plug body 30. The outer plug contact 33 usually has an annular shape and may optionally be segmented, where each segment is inwardly biased. The mounting flange 34 includes mounting threads 35 which are used to affix the plug connector 13 to a mounting support (not shown) which is attached to one end of the aforementioned cable.

As exemplified in FIG. 6 and further exemplified in FIGS. 2B-4B, the bi-conducting RCA plug connector 13 further includes a center plug contact terminal 36 which is electrically connected to the electrically conductive center pin 31. The center plug contact terminal 36 provides an electrical connection to an inner conductor 81 of a two-conductor cable such as a conventional coaxial cable 14 and the like. The plug connector 13 yet further includes an outer plug contact terminal 37 which is electrically connected to the electrically conductive outer plug contact 33. The outer plug contact terminal 37 provides an electrical connection to a ground conductor 82 of the cable 14. It is noted that in some applications the cable 14 may be an unshielded, two-conductor cable, in which case the center plug contact terminal 36 would be electrically connected to one conductor in the cable and the outer plug contact terminal 37 would be electrically connected to the other conductor in the cable.

As exemplified in FIG. 5, the bi-conducting RCA socket connector 12 and plug connector 13 are mated together by having the electrically conductive center pin 31 of the plug connector inserted into the electrically conductive center receptacle 16 of the socket connector, thus making one electrical connection there-between. Simultaneous with this mating operation, the electrically conductive outer plug contact 33 of the plug connector 13 slides over and around the electrically conductive outer socket contact 18 of the socket connector 12, thus making another electrical connection there-between.

2.0 RCA-Compatible Connectors for Balanced and Unbalanced Interfaces

Generally speaking, the RCA-compatible connector embodiments described herein involve connectors for electronic equipment signal interfaces. More particularly and as will be described in more detail hereafter, the RCA-compatible connector embodiments involve a tri-conducting plug connector and a tri-conducting socket connector which are suitable for physically and electrically mating with each other. The tri-conducting plug connector is also suitable for physically and electrically mating with bi-conducting socket connectors (such as the bi-conducting RCA socket connector described heretofore). The tri-conducting socket connector is also suitable for physically and electrically mating with bi-conducting plug connectors (such as the bi-conducting RCA plug connector described heretofore).

The RCA-compatible connector embodiments described herein are advantageous for a variety of reasons including, but not limited to, the following. Generally speaking, the RCA-compatible connector embodiments have the same attributes of small size and low cost as the conventional, bi-conducting RCA connectors described heretofore. The RCA-compatible connector embodiments are electrically and mechanically/physically compatible with conventional, bi-conducting RCA connectors. The RCA-compatible connector embodiments can be used with conventional cables. The RCA-compatible connector embodiments can be used to provide a balanced, unbalanced or hybrid audio or video interface. Similar to conventional bi-conducting RCA connectors, the RCA-compatible connector embodiments do not need a specific rotational alignment for mating, and they rely at least in part on friction to maintain a mating relationship. The RCA-compatible connector embodiments described herein can also be easily integrated into existing electronic equipment designs in order to upgrade the performance of signal interfaces between different pieces of electronic equipment. By way of example but not limitation, and as will be described in more detail hereafter, the RCA-compatible connector embodiments can be employed in a piece of destination equipment and the destination equipment can be connected to a piece of source equipment employing conventional, bi-conducting RCA connectors.

In describing the RCA-compatible connector embodiments, the customary convention of having socket connectors mounted on the aforementioned mounting panel of the source and destination electronic equipment, and having plug connectors mounted on the ends of cables is followed unless otherwise specified. Those having skill in the art of electronics will appreciate that this convention could also be reversed. Additionally, socket connectors and plug connectors may be used in various combinations at the cable ends or on (or as part of) adaptors.

Figures 13A, 13B:
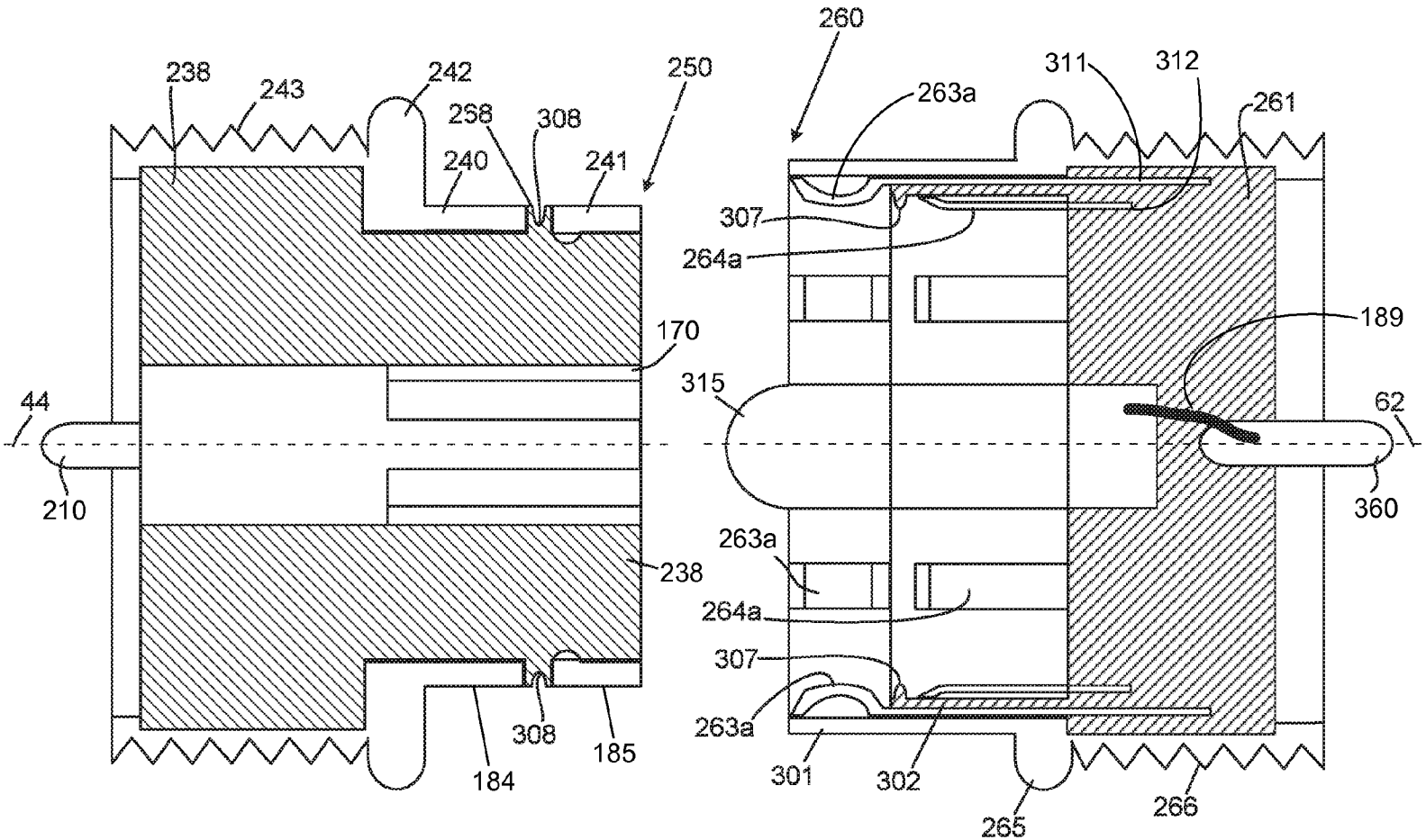
FIG. 13A is a diagram illustrating a cross-sectional view of the socket connector of FIG. 10A
FIG. 13B is a diagram illustrating a cross-sectional view of the plug connector of FIG. 10B.
Figure 14:
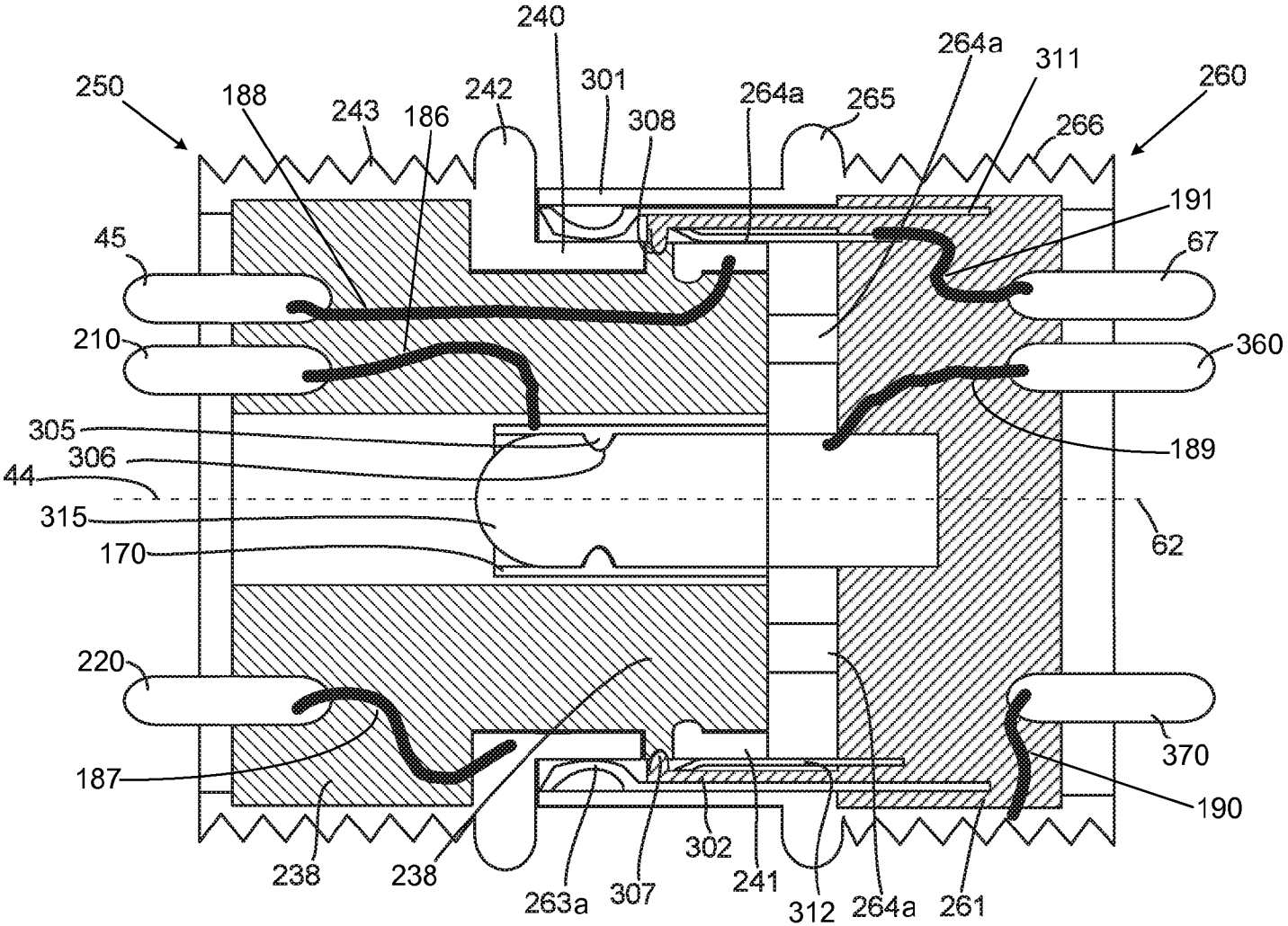
FIG. 14 is a diagram illustrating one cross-sectional view of the socket connector of FIG. 7A and the plug connector of FIG. 7B mated together.
Figure 15:
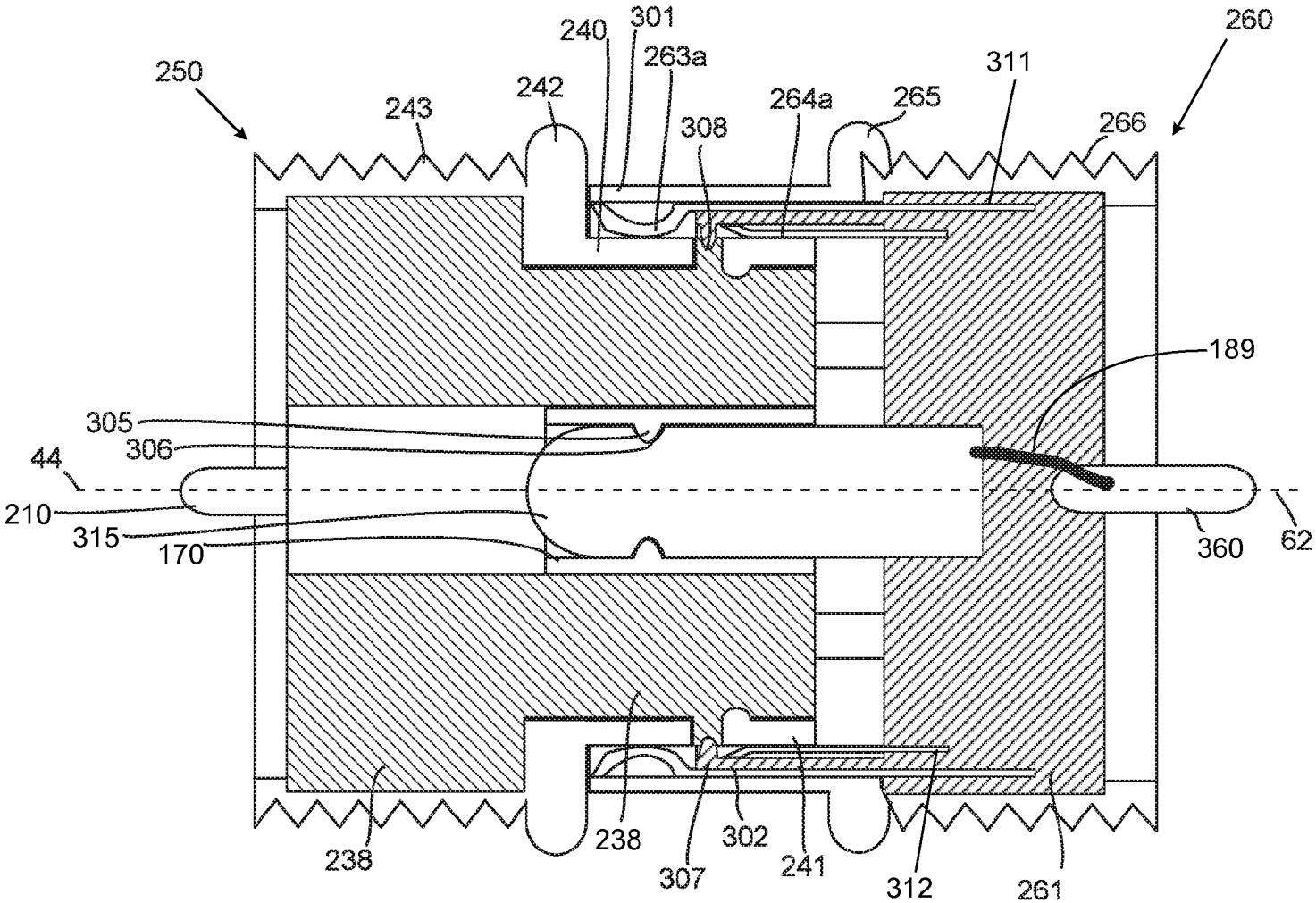
FIG. 15 is a diagram illustrating another cross-sectional view of the socket connector of FIG. 7A and the plug connector of FIG. 7B mated together.
Figure 18:
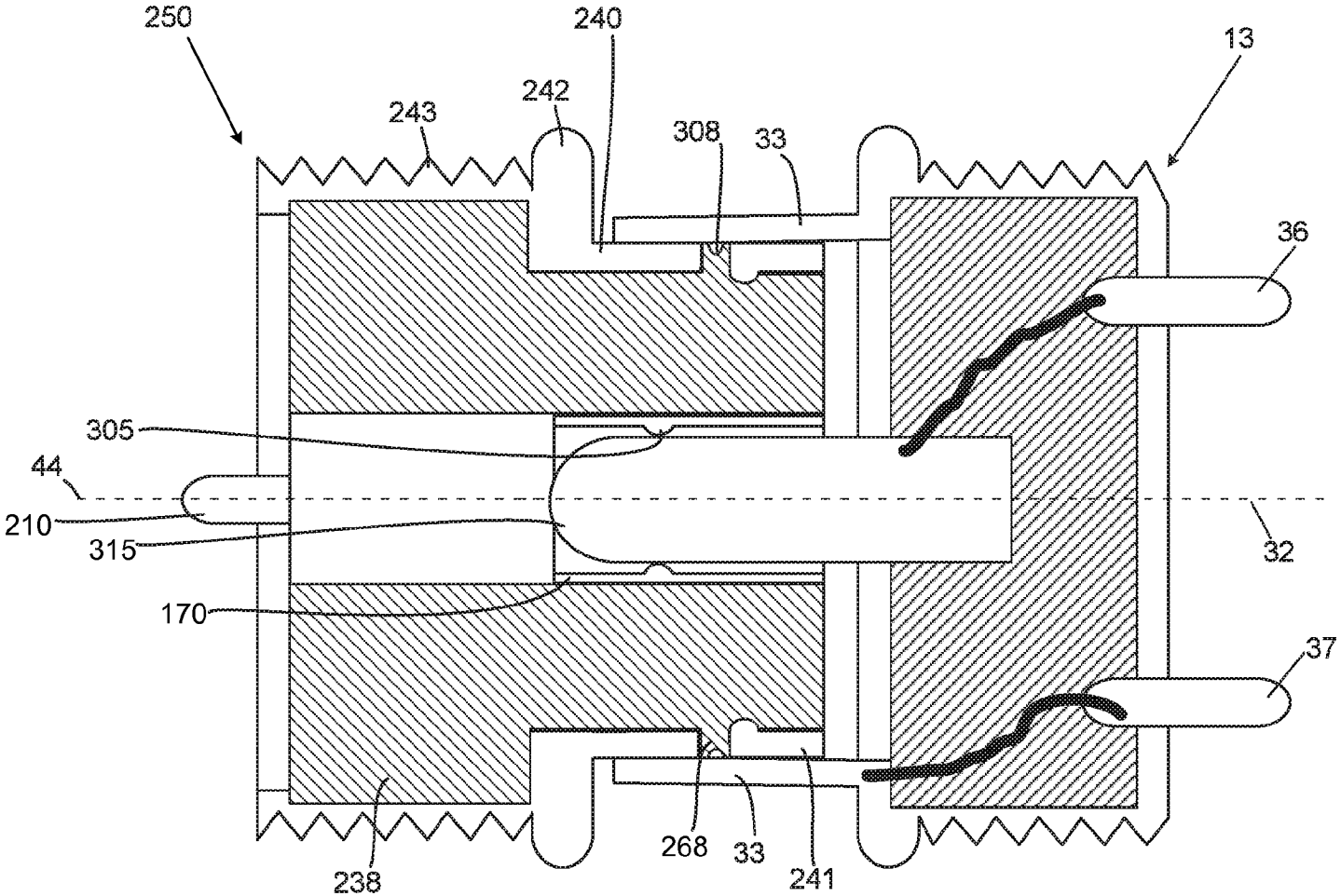
FIG. 18 is a diagram illustrating a cross-sectional side view of the tri-conducting, RCA-compatible socket connector of FIG. 7A mated with a conventional, bi-conducting RCA plug connector.

Generally speaking, FIGS. 7-11, 13-15 and 18 illustrate one embodiment of the construction of a tri-conducting, RCA-compatible socket connector. More particularly, FIG. 7A illustrates a perspective view of one embodiment of a tri-conducting, RCA-compatible socket connector. FIG. 8A illustrates a front view of the socket connector of FIG. 7A. FIG. 9A illustrates one side view of the socket connector of FIG. 7A. FIG. 10A illustrates another side view of the socket connector of FIG. 7A. FIG. 11A illustrates a cross-sectional view of the socket connector of FIG. 9A. FIG. 13A illustrates a cross-sectional view of the socket connector of FIG. 10A. FIG. 14 illustrates one cross-sectional view of the socket connector of FIG. 7A mated with an exemplary embodiment of a tri-conducting, RCA-compatible plug connector. FIG. 15 illustrates another cross-sectional view of the socket connector of FIG. 7A mated with the exemplary embodiment of the tri-conducting, RCA-compatible plug connector. FIG. 18 illustrates a cross-sectional side view of socket connector of FIG. 7A mated with a conventional, bi-conducting RCA plug connector.

As exemplified in FIGS. 7A-11A, 13A, 14, 15 and 18, the tri-conducting, RCA-compatible socket connector 250 is constructed as follows. The socket connector 250 includes an electrically non-conductive (i.e., insulative) socket body 238, an electrically conductive center receptacle 160, an electrically conductive first outer socket contact 240, and an electrically conductive second outer socket contact 241. The socket body 238 typically has a cylindrical shape and serves to maintain the first and second outer socket contacts 240 and 241 electrically isolated from each other and from the center receptacle 160 whenever the socket connector 250 is not mated with a bi-conducting RCA plug connector. The center receptacle 160 has a longitudinal axis 44 (shown as a dashed line in FIGS. 11A, 13A, 14, 15 and 18) which is usually coincident with the longitudinal axis of the socket body 238. The center receptacle 160 includes a cavity typically having a circular cross-section formed in the socket body 238, and one or more electrically conductive central contacts 170 which are placed adjacent the periphery of the cavity. The socket connector 250 may also include a first annular mounting flange 242. The mounting flange 242 includes mounting threads 243 which are used to affix the socket connector 250 to a mounting panel (not shown) on the aforementioned source and destination electronic equipment 10 and 11. The mounting flange 242 and its threads 243 may be either electrically conductive or non-conductive. In the situation where the mounting flange 242 and its threads 243 are electrically conductive, they will be electrically connected to the first outer socket contact 240, and they may be formed as a unitary whole with the first outer socket contact as exemplified in FIGS. 11A, 13A, 15 and 18.

As further exemplified in FIGS. 7A-11A, 13A, 14, 15 and 18, the tri-conducting, RCA-compatible socket connector 250 further includes a center socket contact terminal 210 which is electrically connected to at least one of the electrically conductive central contacts 170 of the center receptacle 160 via a first socket wire 186 or a like means. The socket connector 250 yet further includes a first outer socket contact terminal 220 which is electrically connected to the electrically conductive first outer socket contact 240 via a second socket wire 187 or a like means. The socket connector 250 yet further includes a second outer socket contact terminal 45 which is electrically connected to the electrically conductive second outer socket contact 241 via a third socket wire 188 or a like means.

Generally speaking and as yet further exemplified in FIGS. 7A-11A, 13A, 14, 15 and 18, the first and second outer socket contacts 240 and 241 are formed as substantially cylindrical, conductive rings which radially surround the electrically non-conductive socket body 238, where each ring has the same longitudinal axis 44 as the center receptacle 160. More particularly, the first outer socket contact 240 includes a first socket contact surface 184 which is radially disposed a first distance from the axis 44, where the first socket contact surface is a radially outer surface of the first outer socket contact. The second outer socket contact 241 includes a second socket contact surface 185 which is radially disposed an approximately equal distance from the axis 44 as the first socket contact surface 184, where the second socket contact surface is a radially outer surface of the second outer socket contact. In other words, the first and second outer socket contacts 240 and 241 are coaxial rings having outer diameters that are approximately equal to each other. The first outer socket contact 240 (and thus the first socket contact surface 184) and the second outer socket contact 241 (and thus the second socket contact surface 185) are separated from each other along the longitudinal axis 44 by an annular space 268. In one embodiment of the socket connector 250 the socket body 238 extends into (i.e., occupies) the annular space 268 as exemplified in FIG. 11A. In an alternate embodiment (not shown) of the socket connector the socket body does not extend into (i.e., does not occupy) the annular space 268.

Referring again to FIGS. 7A, 9A-11A, 13A, 14, 15 and 18, in typical uses the tri-conducting, RCA-compatible socket connector 250 will be affixed to a piece of source or destination equipment. The center socket contact terminal 210 provides a high signal electrical connection to circuitry in the equipment. The first outer socket contact terminal 220 provides a ground connection to circuitry in the equipment. The second outer socket contact terminal 45 provides a low signal electrical connection to circuitry in the equipment.

Figure 11A:
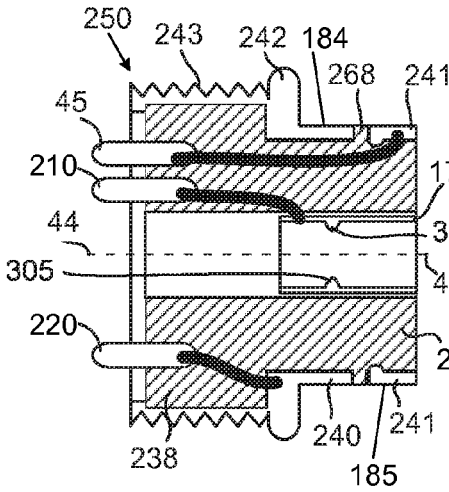
FIG. 11A is a diagram illustrating a cross-sectional view of the socket connector of FIG. 9A
Figure 11B:
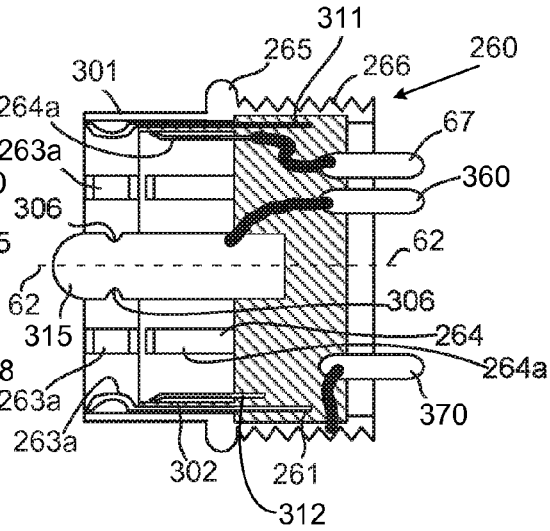
FIG. 11B is a diagram illustrating a cross-sectional view of the socket connector of FIG. 9B.
Figure 12:
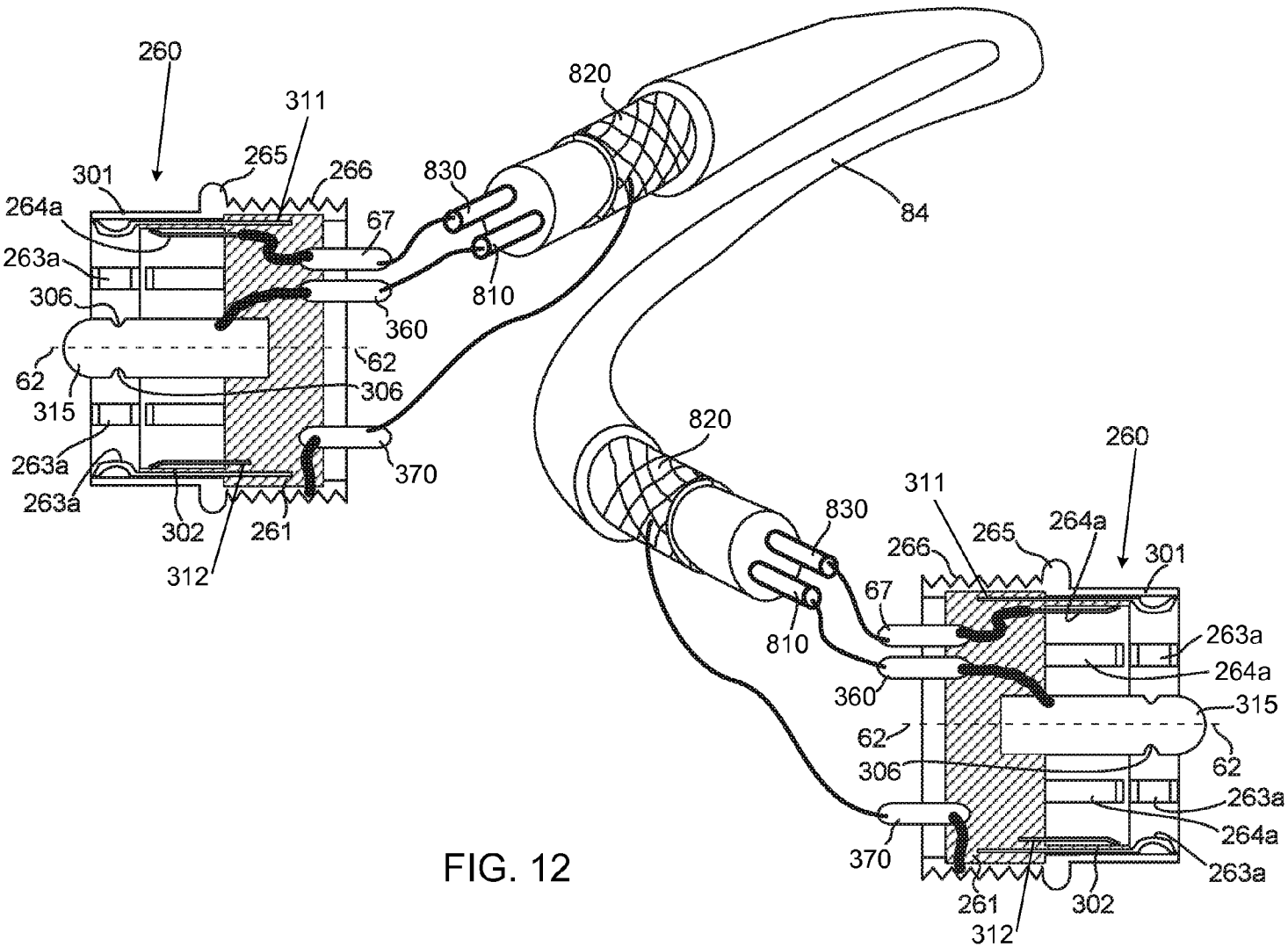
FIG. 12 is a diagram illustrating a partially sectioned, partially cut-away and partially exploded side view of an exemplary embodiment of a three-conductor cable and its connections to a first plug connector of FIG. 7B on one end of the cable and a second plug connector of FIG. 7B on the other end of the cable.
Figure 17:
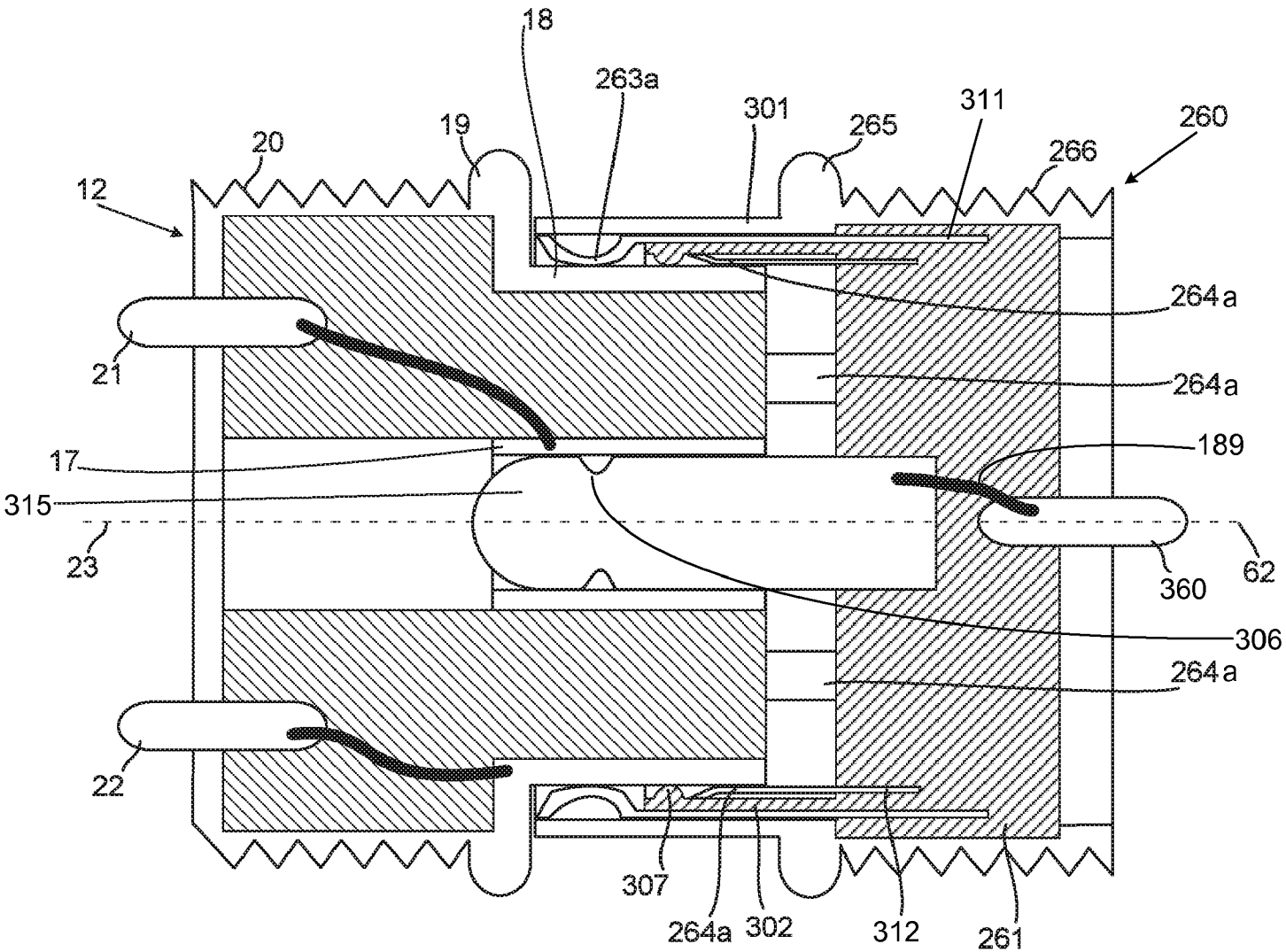
FIG. 17 is a diagram illustrating a cross-sectional side view of a conventional, bi-conducting RCA socket connector mated with the tri-conducting, RCA-compatible plug connector of FIG. 7B.
Figure 21A:
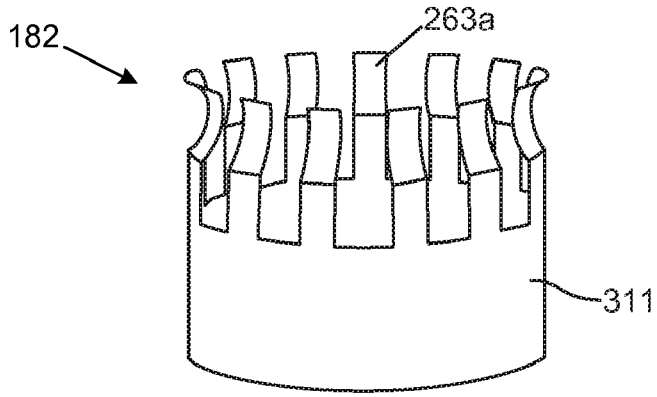
FIGS. 21A and 21B are diagrams illustrating a view shown from the front and slightly above of another embodiment of the first outer plug contact and the second outer plug contact respectively that are employed in the plug connector of FIG. 7B.
Figure 21B:
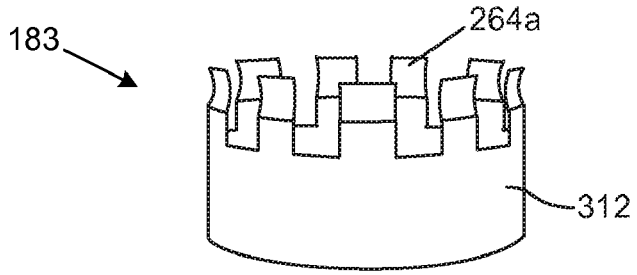

Generally speaking, FIGS. 7-15, 17, 21A and 21B illustrate one embodiment of the construction of a tri-conducting, RCA-compatible plug connector. More particularly, FIG. 7B illustrates a perspective view of one embodiment of a tri-conducting, RCA-compatible plug connector. FIG. 8B illustrates a front view of the plug connector of FIG. 7B. FIG. 9B illustrates one side view of the plug connector of FIG. 7B. FIG. 10B illustrates another side view of the plug connector of FIG. 7B. FIG. 11B illustrates a cross-sectional view of the plug connector of FIG. 9B. FIG. 12 illustrates a partially sectioned, partially cut-away and partially exploded side view of an exemplary embodiment of a three-conductor cable and its connections to a first plug connector of FIG. 7B on one end of the cable and a second plug connector of FIG. 7B on the other end of the cable. FIG. 13B illustrates a cross-sectional view of the plug connector of FIG. 10B. FIG. 14 illustrates one cross-sectional view of the socket connector of FIG. 7A mated with the plug connector of FIG. 7B. FIG. 15 illustrates another cross-sectional view of the socket connector of FIG. 7A mated with the plug connector of FIG. 7B. FIG. 17 illustrates a cross-sectional side view of a conventional, bi-conducting RCA socket connector mated with the plug connector of FIG. 7B. FIGS. 21A and 21B illustrate a view shown from the front and slightly above of one embodiment of a first outer plug contact and second outer plug contact respectively that are employed in the plug connector of FIG. 7B.

As exemplified in FIGS. 7B-11B, 12, 13B, 14, 15, 17, 21A and 21B, the tri-conducting, RCA-compatible plug connector 260 is constructed as follows. The plug connector 260 includes an electrically non-conductive (i.e., insulative) plug body 261, an electrically conductive center pin 315, an electrically conductive first outer plug contact 182, and an electrically conductive second outer plug contact 183. The plug body 261 typically has a cylindrical shape and serves to maintain the first and second outer plug contacts 182 and 183 electrically isolated from each other and from the center pin 315 whenever the plug connector 260 is not mated with a bi-conducting RCA socket connector. The center pin 315 has a longitudinal axis 62 (shown as a dashed line in FIGS. 11B, 12, 13B, 14, 15 and 17) which is usually coincident with the longitudinal axis of the plug body 261. The plug connector 260 may also include a second annular mounting flange 265 which includes mounting threads 266. The mounting flange 265 and its threads 266 can be either electrically conductive or non-conductive. In the situation where the mounting flange 265 and its threads 266 are electrically conductive, they will be electrically connected to the first outer plug contact 182 via physically pressing against it or a like means.

Generally speaking and referring again to FIGS. 7B-11B, 12, 13B, 14, 15, 17, 21A and 21B, the first and second outer plug contacts 182 and 183 are formed as substantially cylindrical, conductive rings which radially surround the electrically non-conductive plug body 261, where each ring has the same longitudinal axis 62 as the center pin 315. The first outer plug contact 182 includes a first plug contact surface which is radially disposed the aforementioned first distance from the axis 62. The second outer plug contact 183 includes a second plug contact surface which is radially disposed an approximately equal distance from the axis 62 as the first plug contact surface. The first outer plug contact 182 (and thus the first plug contact surface) and the second outer plug contact 183 (and thus the second plug contact surface) are separated from each other along the axis 62 of the center pin 315.

In the tri-conducting, RCA-compatible plug connector embodiment 260 exemplified in FIGS. 7B-11B, 12, 13B, 14, 15, 17, 21A and 21B, the first outer plug contact 182 is formed as a solid but flexible, electrically conductive first ring 311 topped with a plurality of electrically conductive first finger strips, where each first finger strip serves as an individually articulated contact. A first resilient plug contact pad 263*a* is disposed at the end of each first finger strip, where the plurality of first contact pads 263*a* forms the aforementioned first plug contact surface. Thus, all of the first contact pads 263*a* are electrically connected to each other via the first ring 311 (i.e., the first ring 311 and contact pads 263*a* form a single, continuous contact). The second outer plug contact 183 is formed as a solid but flexible, electrically conductive second ring 312 topped with a plurality of electrically conductive second finger strips, where each second finger strip serves as an individually articulated contact. A second resilient plug contact pad 264*a* is disposed at the end of each second finger strip, where the plurality of second contact pads 264*a* forms the aforementioned second plug contact surface. Thus, all of the second contact pads 264*a* are electrically connected to each other via the second ring 312 (i.e., the second ring 312 and contact pads 264*a* also form a single, continuous contact). In other words, the first and second plug contact surfaces are each formed of a split or segmented ring.

As further exemplified in FIGS. 11B, 12, 13B, 14, 15, 17, 21A and 21B, the tri-conducting, RCA-compatible plug connector 260 also includes an annular insulator 302 which is radially disposed in-between the first and second plug contact surfaces such that the annular insulator maintains the first and second plug contact surfaces (i.e., the first resilient plug contact pads 263*a* and second resilient plug contact pads 264*a*) electrically isolated from each other whenever the plug connector is not mated with a bi-conducting RCA socket connector. The electrically non-conductive plug body 261 can be formed to include the annular insulator 302 as a unitary whole.

As yet further exemplified in FIGS. 9B-11B, 12, 13B, 14, 15, 17, 21A and 21B, the tri-conducting, RCA-compatible plug connector 260 further includes a center plug contact terminal 360 which is electrically connected to the electrically conductive center pin 315 via a first plug wire 189 or a like means. The plug connector 260 yet further includes a first outer plug contact terminal 370 which is electrically connected to the electrically conductive first outer plug contact 182 and its resilient contact pads 263*a* in a manner which will be described in more detail hereafter. The plug connector 260 yet further includes a second outer plug contact terminal 67 which is electrically connected to the electrically conductive second outer plug contact 183 and its resilient contact pads 264*a* via a second plug wire 191 or a like means.

Referring again to FIGS. 1 and 12, in typical uses the second annular mounting flange 265 and its mounting threads 266 are employed to affix the tri-conducting, RCA-compatible plug connector 260 to a mounting support (not shown) at one or both ends of a three-conductor cable 84. This cable 84 has a high signal conductor 810, a low signal conductor 830 and a ground conductor 820. In the embodiment of the three-conductor cable 84 exemplified in FIG. 12, the ground conductor 820 is formed as an outer shield that radially surrounds the high and low signal conductors 810 and 830. However, it is noted that an alternate embodiment (not shown) of the three-conductor cable is also possible where the ground conductor 820 is not formed as this shield but rather the ground conductor can be formed in a manner similar to the high and low signal conductors 810 and 830 (i.e., the cable is unshielded). As exemplified in FIG. 12, a first electrical connection is provided between the high signal conductor 810 and the center plug contact terminal 360. A second electrical connection is provided between the low signal conductor 830 and the second outer plug contact terminal 67. A third electrical connection is provided between the ground conductor 820 and the first outer plug contact terminal 370.

Referring again to FIGS. 7B-11B, 12, 13B, 14, 15, 17, 21A and 21B, the tri-conducting, RCA-compatible plug connector 260 may also include a shroud 301 which is radially disposed around the first outer plug contact 182 and second outer plug contact 183. The principal purpose of the shroud 301 is to provide strength and support for the plug connector's 260 structure, particularly the electrically conductive first resilient plug contact pads 263*a* of the electrically conductive first outer plug contact 182. In a first embodiment of the plug connector 260 the shroud 301 can be formed of an electrically conductive material that provides electrical shielding and mechanical protection for the first contact pads 263*a* within the shroud. In this case, the shroud 301 will be electrically connected to the electrically conductive second annular mounting flange 265 as exemplified in FIGS. 11B, 12, 13B, 14, 15 and 17. As more particularly exemplified in FIGS. 11B, 12 and 14, in this first embodiment of the plug connector 260 the first outer plug contact terminal 370 is electrically connected to the electrically conductive mounting threads 266 on the flange 265 via a third plug wire 190 or a like means. The electrically conductive shroud 301, electrically conductive flange 265 and electrically conductive threads 266 on the flange provide a means for electrically connecting to the first outer plug contact 182 and its resilient contact pads 263*a*. In an alternate embodiment of the plug connector 260 the shroud 301 can be formed of an electrically insulative material (such as a rigid polymer, resin, and the like) which provides electrical insulation and mechanical protection for the first contact pads 263*a* within the shroud. In this case, the shroud 301, mounting flange 265 and mounting threads 266 on the flange can all be formed of the electrically insulative material. In this alternate embodiment of the plug connector 260 the first outer plug contact terminal 370 can be electrically connected directly to the first outer plug contact 182 and its resilient contact pads 263*a* via a fourth plug wire (not shown) or a like means. In embodiments of the plug connector 260 where the shroud 301, mounting flange 265 and mounting threads 266 on the flange share the same electrical characteristic (i.e., they are either all electrically conductive or all electrically non-conductive/insulative), then the shroud, mounting flange and mounting threads on the flange can be formed as a unitary whole as exemplified in FIGS. 11B, 12, 13B, 14, 15 and 17.

Referring again to FIGS. 11A, 11B, 12, 13A, 13B, 14, 15 and 17, when the tri-conducting, RCA-compatible plug connector 260 is viewed at an angle perpendicular to the longitudinal axis 62 of the electrically conductive center pin 315, the electrically conductive first resilient plug contact pads 263*a* and the electrically conductive second resilient plug contact pads 264*a* are seen to be longitudinally separated from each other. The first and second outer plug contacts 182 and 183 are disposed such that the portions of their respective contact pads 263*a* and 264*a* that are closest to the center pin's axis 62 are approximately radially equidistant from the axis. The radial distance between the center pin's axis 62 and the contact pads of the first and second outer plug contacts 263*a* and 264*a* is sized such that whenever the plug connector 260 is mated with the tri-conducting, RCA-compatible socket connector 250 (as exemplified in FIGS. 14 and 15), the aforementioned first plug contact surface (i.e., the first plug contact pads 263*a*) rest against the socket connector's first socket contact surface 184 of the electrically conductive first outer socket contact 240, and the aforementioned second plug contact surface (i.e., the second plug contact pads 264*a*) rest against the socket connector's second socket contact surface 185 of the electrically conductive second outer socket contact 241, thus making electrical connections between the parts that are resting against each other. The shroud 301, first plug contact pads 263*a* and second plug contact pads 264*a* are formed of a material that is sufficiently resilient so that the plug connector 260 can releasably mate with socket connectors. Depending on the resiliency of the first and second plug contact pads 263*a* and 264*a*, the first outer socket contact 240, and the second outer socket contact 241, whenever the plug and socket connectors 260 and 250 are not mated the radial distance from the center pin's axis 62 to the first and second plug contact pads is equal to or slightly less than the radial distance between the longitudinal axis 44 of the socket connector's electrically conductive center receptacle 160 and the first and second outer socket contacts 240 and 241.

Referring again to FIGS. 14, 17 and 18, in an exemplary embodiment of the tri-conducting, RCA-compatible socket connector 250 the radius of the first socket contact surface 184 of the first outer socket contact 240 and the radius of the second socket contact surface 185 of the second outer socket contact 241 are substantially the same as the outer radius of the outer socket contact 18 of a conventional, bi-conducting RCA socket connector 12. Additionally, the total (i.e., combined) length of the first outer socket contact 240, annular space 268 and second outer socket contact 241 (i.e., the length from the first annular mounting flange 242 to the forward tip of the socket connector) is approximately the same as the length of the outer socket contact 18 of the bi-conducting RCA socket connector 12. This allows for complete compatibility when physically and electrically mating the tri-conducting socket connector 250 with a conventional, bi-conducting RCA plug connector 13 as exemplified in FIG. 18. As can be seen in FIG. 18, whenever the tri-conducting socket connector 250 is mated with the bi-conducting plug connector 13 the bi-conducting plug connector's electrically conductive outer plug contact 33 bridges (i.e., electrically interconnects) the tri-conducting socket connector's first and second outer socket contacts 240 and 241. As a result, the tri-conducting socket connector's first and second outer socket contact terminals 220 and 45 are electrically connected to each other.

Similarly, and referring yet again to FIGS. 14, 17 and 18, in an exemplary embodiment of the tri-conducting, RCA-compatible plug connector 260 the inner radius of the first resilient plug contact pads 263*a* and the inner radius of the second resilient plug contact pads 264*a* are substantially the same as the inner radius of the outer plug contact 33 of a conventional, bi-conducting RCA plug connector 13. Additionally, the total (i.e., combined) length of the first outer plug contact 182 and second outer plug contact 183 is approximately the same as the length of the outer plug contact 33 of the bi-conducting RCA plug connector 13. This allows for complete compatibility when physically and electrically mating the tri-conducting plug connector 260 with a conventional, bi-conducting RCA socket connector 12 as exemplified in FIG. 17. As can be seen in FIG. 17, whenever the tri-conducting plug connector 260 is mated with the bi-conducting socket connector 12, the bi-conducting socket connector's electrically conductive outer socket contact 18 bridges (i.e., electrically interconnects) the tri-conducting plug connector's first contact pads 263*a* and second contact pads 264*a* (i.e., the first and second outer plug contacts 182 and 183 become electrically connected to each other). As a result, the tri-conducting plug connector's first outer plug contact terminal 370 and second outer plug contact terminal 67 are electrically connected to each other.

Generally speaking, FIGS. 19A-19H are diagrams illustrating sides views of various embodiments of balanced and unbalanced interfaces between a piece of source electronic equipment and a piece of destination electronic equipment, where the interfaces use different combinations of conventional, bi-conducting RCA connectors and tri-conducting, RCA-compatible connectors. Regarding these FIGS., a "U" shown inside a piece of source electronic equipment 10 indicates that this equipment has a driver configured for unbalanced operation. A "U" shown inside a piece of destination electronic equipment 11 indicates that this equipment has a receiver configured for unbalanced operation. A "B" shown inside a piece of source electronic equipment 90 indicates that this equipment has a driver configured for balanced operation. A "B" shown inside a piece of destination electronic equipment 91 indicates that this equipment has a receiver configured for balanced operation.

Referring again to FIGS. 19A-19H, whenever a piece of source electronic equipment having a driver configured for unbalanced operation is depicted, the output connector on the equipment is shown as a bi-conducting RCA socket connector 12. Whenever a piece of destination electronic equipment having a receiver configured for unbalanced operation is depicted, the input connector on the equipment is also shown as a bi-conducting RCA socket connector 12. Whenever a two-conductor cable 14 (such as a conventional coaxial cable and the like) is depicted, it is shown having a bi-conducting RCA plug connector 13 at each end. However, it is understood that any of the tri-conducting, RCA-compatible plug connector embodiments described herein (such as 260 and 260*a*) can be substituted for the bi-conducting RCA plug connector and the unbalanced interface formed there-from will operate exactly as the unbalanced interface formed from the bi-conducting RCA plug connector. Whenever a piece of source electronic equipment having a driver configured for balanced operation is depicted, the output connector on the equipment is shown as a tri-conducting, RCA-compatible socket connector 250. Whenever a piece of destination electronic equipment having a receiver configured for balanced operation is depicted, the input connector on the equipment is also shown as a tri-conducting, RCA-compatible socket connector 250. Whenever a three-conductor cable 84 is depicted, it is shown as having a tri-conducting, RCA-compatible plug connector 260 at each end.

Figure 19A:
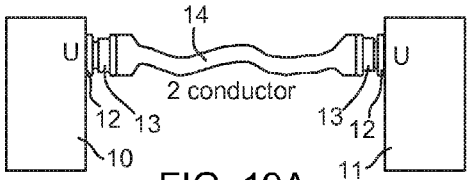
FIGS. 19A-19H are diagrams illustrating side view of various embodiments of balanced and unbalanced interfaces between a piece of source electronic equipment and a piece of destination electronic equipment, where the interfaces use different combinations of conventional, bi-conducting RCA connectors and tri-conducting, RCA-compatible connectors.

FIG. 19A illustrates a side view of one embodiment of an interface between a piece of source electronic equipment 10 having a driver configured for unbalanced operation and a piece of destination electronic equipment 11 having a receiver also configured for unbalanced operation. The source equipment 10 employs a bi-conducting RCA socket connector 12 as an output connector. The destination equipment 11 employs a bi-conducting RCA socket connector 12 as an input connector. The source and destination equipment 10 and 11 are electrically interconnected by a two-conductor cable 14 having a bi-conducting RCA plug connector 13 at each end, where one plug connector is mated with the socket connector on the source equipment and the other plug connector is mated with the socket connector on the destination equipment. In this situation the two-conductor cable 14 provides an unbalanced interface between the source and destination equipment 10 and 11.

Figure 19E:
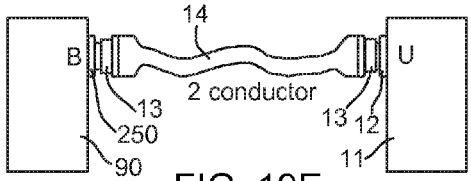
Figure 19B:
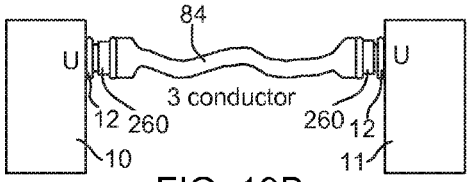

FIG. 19B illustrates a side view of another embodiment of an interface between a piece of source electronic equipment 10 having a driver configured for unbalanced operation and a piece of destination electronic equipment 11 having a receiver also configured for unbalanced operation. The source equipment 10 employs a bi-conducting RCA socket connector 12 as an output connector. The destination equipment 11 employs a bi-conducting RCA socket connector 12 as an input connector. The source and destination equipment 10 and 11 are electrically interconnected by a three-conductor cable 84 having a tri-conducting, RCA-compatible plug connector 260 at each end, where one tri-conducting plug connector is mated with the bi-conducting socket connector on the source equipment and the other tri-conducting plug connector is mated with the bi-conducting socket connector on the destination equipment. In this situation the three-conductor cable 84 provides an unbalanced interface between the source and destination equipment 10 and 11, where this interface generally has the same performance as that shown in FIG. 19A.

Figure 19F:
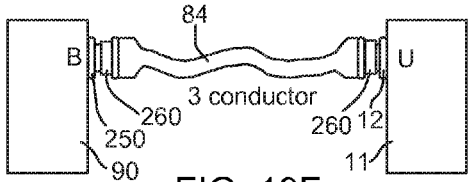
Figure 19C:
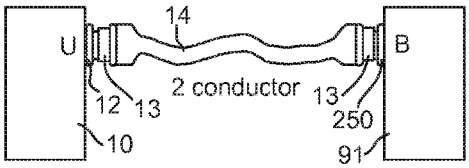

FIG. 19C illustrates a side view of one embodiment of an interface between a piece of source electronic equipment 10 having a driver configured for unbalanced operation and a piece of destination electronic equipment 91 having a receiver configured for balanced operation. The source equipment 10 employs a bi-conducting RCA socket connector 12 as an output connector. The destination equipment 91 employs a tri-conducting, RCA-compatible socket connector 250 as an input connector. The source and destination equipment 10 and 91 are electrically interconnected by a two-conductor cable 14 having a bi-conducting RCA plug connector 13 at each end, where one plug connector is mated with the bi-conducting socket connector 12 on the source equipment and the other plug connector is mated with the tri-conducting socket connector 250 on the destination equipment. In this situation the two-conductor cable 14 provides an unbalanced interface between the source and destination equipment 10 and 91, where this interface generally has the same performance as that shown in FIG. 19A.

Figure 19G:
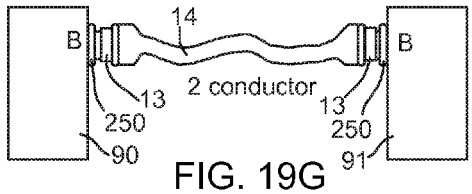
Figure 19D:
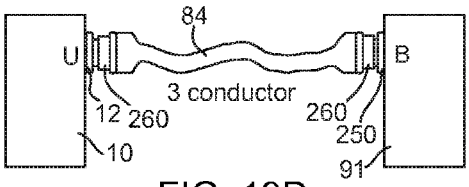

FIG. 19D illustrates a side view of another embodiment of an interface between a piece of source electronic equipment 10 having a driver configured for unbalanced operation and a piece of destination electronic equipment 91 having a receiver configured for balanced operation. The source equipment 10 employs a bi-conducting RCA socket connector 12 as an output connector. The destination equipment 91 employs a tri-conducting, RCA-compatible socket connector 250 as an input connector. The source and destination equipment 10 and 91 are electrically interconnected by a three-conductor cable 84 having a tri-conducting, RCA-compatible plug connector 260 at each end, where one tri-conducting plug connector is mated with the bi-conducting socket connector 12 on the source equipment and the other tri-conducting plug connector is mated with the tri-conducting socket connector 250 on the destination equipment. In this situation, although the three-conductor cable 84 provides an "end-to-end" unbalanced interface between the source and destination equipment 10 and 91, those skilled in the art of electronics will appreciate that this interface has a level of performance that is significantly better than the performance of the interfaces shown in FIGS. 19A-19C. The reason for this better performance is because the common-impedance coupling in the three-conductor cable 84 is eliminated since the aforementioned low signal conductor and ground conductor (which can be formed as an outer shield as described heretofore) of the cable carry the signal and interference currents separately.

FIG. 19E illustrates a side view of one embodiment of an interface between a piece of source electronic equipment 90 having a driver configured for balanced operation and a piece of destination electronic equipment 11 having a receiver configured for unbalanced operation. The source equipment 90 employs a tri-conducting, RCA-compatible socket connector 250 as an output connector. The destination equipment 11 employs a bi-conducting RCA socket connector 12 as an input connector. The source and destination equipment 90 and 11 are electrically interconnected by a two-conductor cable 14 having a bi-conducting RCA plug connector 13 at each end, where one plug connector is mated with the tri-conducting socket connector 250 on the source equipment and the other plug connector is mated with the bi-conducting socket connector 12 on the destination equipment. In this situation the two-conductor cable 14 provides an unbalanced interface between the source and destination equipment 10 and 11, where this interface generally has the same performance as that shown in FIG. 19A.

FIG. 19F illustrates a side view of another embodiment of an interface between a piece of source electronic equipment 90 having a driver configured for balanced operation and a piece of destination electronic equipment 11 having a receiver configured for unbalanced operation. The source equipment 90 employs a tri-conducting, RCA-compatible socket connector 250 as an output connector. The destination equipment 11 employs a bi-conducting RCA socket connector 12 as an input connector. The source and destination equipment 90 and 11 are electrically interconnected by a three-conductor cable 84 having a tri-conducting, RCA-compatible plug connector 260 at each end, where one tri-conducting plug connector is mated with the tri-conducting socket connector 250 on the source equipment and the other tri-conducting plug connector is mated with the bi-conducting socket connector 12 on the destination equipment. In this situation, although the three-conductor cable 84 provides an "end-to-end" unbalanced interface between the source and destination equipment 90 and 11, those skilled in the art of electronics will appreciate that this interface will have a level of performance that is significantly better than the performance of the interfaces shown in FIGS. 19A if the source equipment 90 has a "floating-type" line driver (i.e., a transformer or an equivalent electronic component having high common mode output impedances) which eliminates common-impedance coupling. Otherwise, this interface will generally have the same performance as that shown in FIG. 19A.

FIG. 19G illustrates a side view of one embodiment of an interface between a piece of source electronic equipment 90 having a driver configured for balanced operation and a piece of destination electronic equipment 91 having a receiver also configured for balanced operation. The source equipment 90 employs a tri-conducting, RCA-compatible socket connector 250 as an output connector. The destination equipment 91 employs the tri-conducting socket connector 250 as an input connector. The source and destination equipment 90 and 91 are electrically interconnected by a two-conductor cable 14 having a bi-conducting RCA plug connector 13 at each end, where one plug connector is mated with the tri-conducting socket connector 250 on the source equipment and the other plug connector is mated with the tri-conducting socket connector 250 on the destination equipment. In this situation the two-conductor cable 14 provides an end-to-end unbalanced interface between the source and destination equipment 90 and 91, where this interface generally has the same performance as that shown in FIG. 19A. Thus, the high performance capabilities of the source and destination equipment 90 and 91 are lost since the cable 14 produces common-impedance coupling.

Figure 19H:
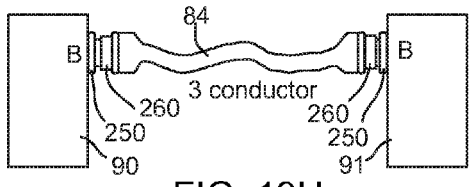

FIG. 19H illustrates a side view of another embodiment of an interface between a piece of source electronic equipment 90 having a driver configured for balanced operation and a piece of destination electronic equipment 91 having a receiver also configured for balanced operation. The source equipment 90 employs a tri-conducting, RCA-compatible socket connector 250 as an output connector. The destination equipment 91 employs the tri-conducting socket connector 250 as an input connector. The source and destination equipment 90 and 91 are electrically interconnected by a three-conductor cable 84 having a tri-conducting, RCA-compatible plug connector 260 at each end, where one plug connector is mated with the tri-conducting socket connector 250 on the source equipment and the other plug connector is mated with the tri-conducting socket connector 250 on the destination equipment. In this situation the three-conductor cable 84 provides an end-to-end balanced interface between the source and destination equipment 90 and 91, where this interface has a level of performance that is better than the performance of any of the interfaces shown in FIGS. 19A-19G. In other words, the overall performance of this end-to-end interface can be on par with any professional balanced interface system.

Given the foregoing, it will be appreciated that in the various embodiments of balanced and unbalanced interfaces that are possible between a piece of source electronic equipment and a piece of destination electronic equipment, whenever a tri-conducting, RCA-compatible plug connector and/or tri-conducting, RCA-compatible socket connector is used on a piece of source electronic equipment, a piece of destination electronic equipment and/or the cable that is used to provide the interface between the pieces of equipment, the resulting performance of the interface is at least as good as what would be achieved using only conventional, bi-conducting RCA plug and socket connectors on the source equipment, destination equipment and cable, and often the performance of the interface is significantly better. A significant advantage of the RCA-compatible connector embodiments described herein is that a piece of destination equipment and the cables running thereto can be upgraded to employ tri-conducting input connectors and three-conductor cables, and these upgrades can increase the performance of the signal interface to a professional level without having to replace existing source equipment having conventional, bi-conducting output connectors.

2.1 Optional Detent Subsystem

This section describes two different embodiments of a detent subsystem which can optionally be included in the RCA-compatible connector embodiments described herein. The detent subsystem embodiments are advantageous for a variety of reasons including, but not limited to, the following. Whenever a user mates a tri-conducting, RCA-compatible plug connector to a tri-conducting, RCA-compatible socket connector, the detent subsystem embodiments provide tactile feedback to the user when the plug and socket connector are properly mated. Furthermore, the detent subsystem embodiments provide a "locking resistance" (in addition to the inherent mere friction) when the plug and socket connectors are properly mated.

FIG. 11A illustrates a first embodiment of the detent subsystem on the tri-conducting, RCA-compatible socket connector 250. FIGS. 11B and 12 illustrate a corresponding first embodiment of the detent subsystem on the tri-conducting, RCA-compatible plug connector 260. As exemplified in FIGS. 11A, 11B and 12, the first detent subsystem includes a first protuberance 305 which extends radially inward from the inner perimeter of each of the socket connector's 250 central contacts 170. The first detent subsystem also includes a first groove 306 which extends radially inward from the outer perimeter of the plug connector's 260 center pin 315. The first protuberance 305 and first groove 306 are co-positioned along their respective longitudinal axes 44 and 62 such that whenever the socket connector 250 and plug connector 260 are pushed together sufficiently for the first resilient plug contact pads 263*a* of the first outer plug contact 182 to rest against the first socket contact surface 184 without also resting on the second socket contact surface 185 (as shown in FIGS. 14 and 15), the first protuberance 305 releasably locks into the first groove 306.

FIG. 13A illustrates a second embodiment of the detent subsystem on the tri-conducting, RCA-compatible socket connector 250. FIG. 13B illustrates a corresponding second embodiment of the detent subsystem on the tri-conducting, RCA-compatible plug connector 260. As exemplified in FIGS. 13A and 13B, the second detent subsystem includes a second protuberance 307 which extends radially inward from the inner perimeter of the plug connector's 260 annular insulator 302. The second detent subsystem also includes a second groove 308 which is formed in the outer perimeter of the portion of the socket connector's 250 non-conductive socket body 238 that extends into the annular space 268 separating the first and second outer socket contacts 240 and 241. In the aforementioned alternate embodiment of the socket connector where the socket body does not extend into (i.e., does not occupy) the annular space 268, then this space can provide the functionality of the second groove. The second protuberance 307 and second groove 308 (and corresponding annular space 268) are co-positioned along their respective longitudinal axes 62 and 44 such that whenever the socket connector 250 and plug connector 260 are pushed together sufficiently for the first resilient plug contact pads 263*a* of the first outer plug contact 182 to rest against the first socket contact surface 184 without also resting on the second socket contact surface 185 (as shown in FIGS. 14 and 15), the second protuberance 307 releasably locks into the second groove 308 (or annular space 268).

It is noted that the RCA-compatible connector embodiments described herein may include either just the aforementioned first embodiment of the detent subsystem, or just the second embodiment of the detent subsystem, or both the first and second embodiments of the detent subsystem at the same time. Furthermore, since the detent subsystem is optional, the RCA-compatible connector embodiments may include no detent subsystem at all. To illustrate these points, FIGS. 11A, 11B and 12 show the RCA-compatible connector embodiments 250 and 260 in an un-mated form having just the first embodiment of the detent subsystem. FIGS. 13A and 13B show the RCA-compatible connector embodiments 250 and 260 in an un-mated form having just the second embodiment of the detent subsystem. FIGS. 14 and 15 show the RCA-compatible connector embodiments 250 and 260 in a mated form having both the first and second embodiments of the detent subsystem at the same time. FIG. 17 shows an embodiment of the tri-conducting, RCA-compatible plug connector 260 having both the aforementioned first groove 306 of the first detent subsystem and the second protuberance 307 of the second detent subsystem, where the plug connector is mated with a bi-conducting RCA socket connector 12. FIG. 18 shows an embodiment of the tri-conducting, RCA-compatible socket connector 250 having both the aforementioned first protuberance 305 of the first detent subsystem and the second groove 308 of the second detent subsystem, where the socket connector is mated with a bi-conducting RCA plug connector 13. As exemplified in FIGS. 17 and 18, the first and second detent subsystems are fully compatible with the bi-conducting RCA connectors. In order to accommodate these different mating scenarios, the electrically non-conductive socket body 238 and electrically conductive central contacts 170 of the tri-conducting socket connector 250, and the annular insulator 302 of the tri-conducting plug connector 260 may be formed of such materials and/or may be shaped so that they are somewhat elastic and/or "springy."

3.0 Additional Embodiments

Figure 16:
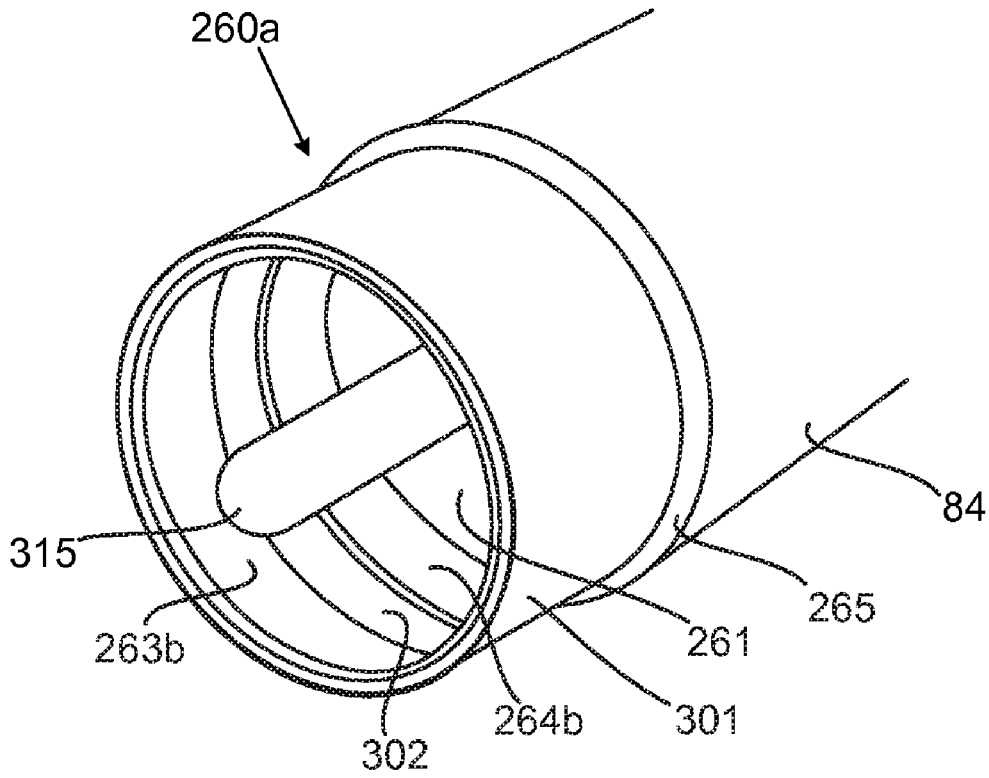
FIG. 16 is a diagram illustrating a perspective view of another embodiment of the tri-conducting, RCA-compatible plug connector.
Figure 20A:
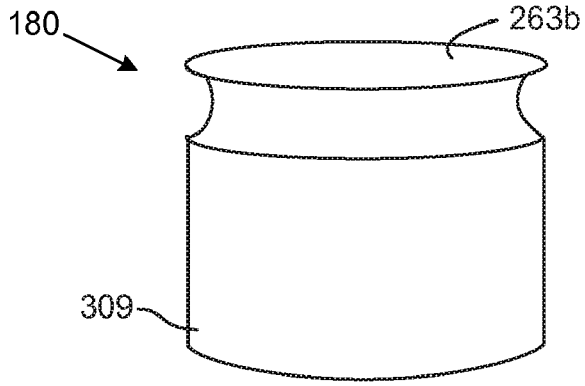
FIGS. 20A and 20B are diagrams illustrating a view shown from the front and slightly above of one embodiment of a first outer plug contact and a second outer plug contact respectively that are employed in the plug connector of FIG. 16.
Figure 20B:
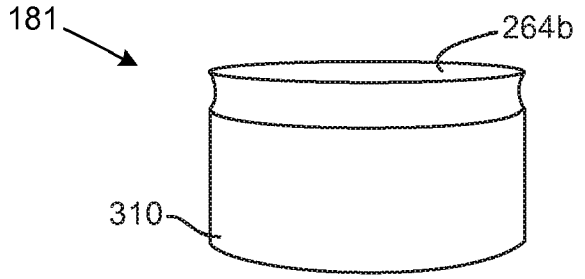

While the RCA-compatible connectors have been described in more detail by specific reference to embodiments thereof, it is understood that variations and modifications thereof can be made without departing from the true spirit and scope of the RCA-compatible connectors. By way of example but not limitation, FIG. 16 illustrates a perspective view of an alternate embodiment of the tri-conducting, RCA-compatible plug connector, and FIGS. 20A and 20B illustrate a view shown from the front and slightly above of an alternate embodiment of the aforementioned electrically conductive first outer plug contact and second outer plug contact respectively that are employed in the plug connector of FIG. 16. As exemplified in FIGS. 16, 20A and 20B, rather than the first outer plug contact being formed as a solid but flexible, electrically conductive first ring topped with a plurality of electrically conductive first finger strips each serving as an individually articulated contact having a first resilient plug contact pad where the plurality of first contact pads forms the aforementioned first plug contact surface as described heretofore, in this alternate embodiment of the plug connector 260*a* the first outer plug contact 180 can be formed as a solid but flexible, electrically conductive third ring 309 and the first plug contact surface can be formed as a first resilient annular contact surface 263*b* on the third ring. Additionally, rather than the second outer plug contact being formed as a solid but flexible, electrically conductive second ring topped with a plurality of electrically conductive second finger strips each serving as an individually articulated contact having a second resilient plug contact pad where the plurality of second contact pads forms the aforementioned second plug contact surface as described heretofore, the second outer plug contact 181 can be formed as a solid but flexible, electrically conductive fourth ring 310 and the second plug contact surface can be formed as a second resilient annular contact surface 264*b*.

It is also noted that any or all of the aforementioned embodiments can be used in any combination desired to form additional hybrid embodiments. Although the RCA-compatible connector embodiments have been described in language specific to structural features and/or methodological acts, it is to be understood that the subject matter defined in the appended claims is not necessarily limited to the specific features or acts described heretofore. Rather, the specific features and acts described heretofore are disclosed as example forms of implementing the claims.

Wherefore, what is claimed is:

1. A plug connector, comprising:

an electrically conductive center pin comprising a longitudinal axis;

an electrically conductive first outer plug contact comprising a first plug contact surface radially disposed a first distance from the axis, wherein a radially inner surface of the first plug contact surface electrically contacts a first socket contact surface of a socket connector;

an electrically conductive second outer plug contact comprising a second plug contact surface radially disposed an approximately equal distance from the axis as the first plug contact surface, wherein the first plug contact surface and second plug contact surface are separated longitudinally from each other along the axis, and a radially inner surface of the second plug contact surface electrically contacts a second socket contact surface of the socket connector;

an annular insulator radially disposed in-between the first and second plug contact surfaces; and an electrically non-conductive plug body, wherein said body and insulator maintain the first and second outer plug contacts electrically isolated from each other and from the center pin.

2. The plug connector of claim 1, wherein the electrically conductive first outer plug contact is formed as a solid but flexible ring, and the first plug contact surface comprises an uninterrupted resilient annular contact surface.

3. The plug connector of claim 1, wherein the electrically conductive first outer plug contact is formed as a solid but flexible ring topped with a plurality of finger strips each serving as an individually articulated contact, and the first plug contact surface comprises a plurality of first resilient plug contact pads, each pad being disposed at an end of a particular finger strip.

4. The plug connector of claim 1, wherein the electrically conductive second outer plug contact is formed as a solid but flexible ring, and the second plug contact surface comprises an uninterrupted resilient annular contact surface.

5. The plug connector of claim 1, wherein the electrically conductive second outer plug contact is formed as a solid but flexible ring topped with a plurality of finger strips each serving as an individually articulated contact, and the second plug contact surface comprises a plurality of second resilient plug contact pads, each pad being disposed at an end of a particular finger strip.

6. The plug connector of claim 1, wherein the electrically non-conductive plug body is formed to comprise the annular insulator as a unitary whole.

7. The plug connector of claim 1, further comprising a shroud radially disposed around the electrically conductive first outer plug contact and second outer plug contact.

8. The plug connector of claim 7, wherein the shroud is electrically conductive.

9. The plug connector of claim 7, wherein the shroud is electrically insulative.

10. The plug connector of claim 1, further comprising a plug detent subsystem that is operable cooperatively with a corresponding socket detent subsystem of a tri-conducting socket connector.

11. The plug connector of claim 10, wherein the plug detent subsystem comprises a groove extending radially inward from an outer perimeter of the electrically conductive center pin, said groove being operable cooperatively with a protuberance extending radially inward from an inner perimeter of electrically conductive central contacts of a central receptacle of the tri-conducting socket connector.

12. The plug connector of claim 10, wherein the plug detent subsystem comprises a protuberance extending radially inward from an inner perimeter of the annular insulator, said protuberance being operable cooperatively with an annular space between a first outer socket contact and a second outer socket contact of the tri-conducting socket connector.

13. The plug connector of claim 1, wherein whenever the plug connector is mated with a tri-conducting socket connector, the first plug contact surface of the electrically conductive first outer plug contact is positionable upon a first socket contact surface of an electrically conductive first outer socket contact of the tri-conducting socket connector, and the second plug contact surface of the electrically conductive second outer plug contact is positionable upon a second socket contact surface of an electrically conductive second outer socket contact of the tri-conducting socket connector.

14. The plug connector of claim 1, wherein, the electrically conductive center pin, first outer plug contact and second outer plug contact are disposed relative to each other such that the plug connector is suitable for mating with a conventional, bi-conducting RCA (Radio Corporation of America) socket connector, and the first and second outer plug contacts become electrically connected to each other whenever the plug connector is mated with the bi-conducting RCA socket connector.

15. The plug connector of claim 1, further comprising:

a first contact terminal electrically connected to the electrically conductive center pin;

a second contact terminal electrically connected to the electrically conductive first outer plug contact; and a third contact terminal electrically connected to the electrically conductive second outer plug contact.

16. A socket connector, comprising:

an electrically conductive center receptacle comprising a longitudinal axis;

an electrically conductive first outer socket contact comprising a first socket contact surface radially disposed a first distance from the axis, wherein the first socket contact surface is a radially outer surface of the first outer socket contact;

an electrically conductive second outer socket contact comprising a second socket contact surface radially disposed an approximately equal distance from the axis as the first socket contact surface, wherein the second socket contact surface is a radially outer surface of the second outer socket contact, and the first socket contact surface and second socket contact surface are separated longitudinally from each other along the axis;

an electrically non-conductive socket body, wherein said body maintains the first and second outer socket contacts electrically isolated from each other and from the center receptacle;

a first contact terminal electrically connected to at least one electrically conductive central contact of the electrically conductive center receptacle;

a second contact terminal electrically connected to the electrically conductive first outer socket contact; and a third contact terminal electrically connected to the electrically conductive second outer socket contact.

17. The socket connector of claim 16, further comprising a socket detent subsystem that is operable cooperatively with a corresponding plug detent subsystem of a tri-conducting plug connector.

18. The socket connector of claim 17, wherein the socket detent subsystem comprises an annular space between the electrically conductive first outer socket contact and second outer socket contact, wherein said space is configured to receive a protuberance extending radially inward from an inner perimeter of an annular insulator of the tri-conducting plug connector.

19. The socket connector of claim 17, wherein the socket detent subsystem comprises a protuberance extending radially inward from an inner perimeter of electrically conductive central contacts of the electrically conductive center receptacle, said protuberance being operable cooperatively with a groove extending radially inward from an outer perimeter of a center pin of the tri-conducting plug connector.

20. The socket connector of claim 16, wherein whenever the socket connector is mated with a tri-conducting plug connector, the first socket contact surface of the electrically conductive first outer socket contact is positionable against a first plug contact surface of an electrically conductive first outer plug contact of the tri-conducting plug connector, and the second socket contact surface of the electrically conductive second outer socket contact is positionable against a second plug contact surface of an electrically conductive second outer plug contact of the tri-conducting plug connector.

21. The socket connector of claim 16, wherein, each of the electrically conductive first and second outer socket contacts is substantially cylindrical and the electrically conductive center receptacle, first outer socket contact and second outer socket contact are disposed relative to each other such that the socket connector is suitable for mating with a conventional, bi-conducting RCA (Radio Corporation of America) plug connector, and the first and second outer socket contacts become electrically connected to each other whenever the socket connector is mated with the bi-conducting RCA plug connector.

22. A method for making a tri-conducting plug connector that is suitable for mating with a tri-conducting socket connector and maintaining three separate electrical connections therewith, and is also suitable for physically and electrically mating with a bi-conducting socket connector, the bi-conducting socket connector comprising an electrically conductive center receptacle and an electrically conductive outer cylindrical socket surface, said method comprising the following steps:

providing an electrically conductive center pin comprising a longitudinal axis;

providing an electrically conductive first outer plug contact comprising a first plug contact surface radially disposed a first distance from the axis;

providing an electrically conductive second outer plug contact comprising a second plug contact surface radially disposed an approximately equal distance from the axis as the first plug contact surface;

disposing the first plug contact surface and second plug contact surface longitudinally apart from each other along the axis;

providing an annular insulator radially disposed in-between the first and second plug contact surfaces; and disposing the center pin, first outer plug contact, second outer plug contact and annular insulator relative to each other upon an electrically non-conductive plug body such that, the first and second outer plug contacts and center pin are maintained electrically isolated from each other absent mating with the bi-conducting socket connector, and whenever the tri-conducting plug connector is mated with the bi-conducting socket connector, the center pin is received in the center receptacle of said bi-conducting socket connector, a radially inner surface of the first plug contact surface and a radially inner surface of the second plug contact surface are positioned against the outer cylindrical socket surface of said bi-conducting socket connector, and the first and second outer plug contacts are electrically connected to each other via said outer cylindrical socket surface.

23. A method for making a tri-conducting socket connector that is suitable for mating with a tri-conducting plug connector and maintaining three separate electrical connections therewith, and is also suitable for physically and electrically mating with a bi-conducting plug connector, the bi-conducting plug connector comprising an electrically conductive center pin and an electrically conductive outer cylindrical plug surface, said method comprising the following steps:

providing an electrically conductive center receptacle comprising a longitudinal axis;

providing an electrically conductive first outer socket contact comprising a first socket contact surface radially disposed a first distance from the axis, wherein the first socket contact surface is a radially outer surface of the first outer socket contact;

providing an electrically conductive second outer socket contact comprising a second socket contact surface radially disposed an approximately equal distance from the axis as the first socket contact surface, wherein the second socket contact surface is a radially outer surface of the second outer socket contact;

disposing the first socket contact surface and the second socket contact surface longitudinally apart from each other along the axis; and disposing the center receptacle, first outer socket contact and second outer socket contact relative to each other upon an electrically non-conductive socket body such that, the first and second outer socket contacts and center receptacle are maintained electrically isolated from each other absent mating with the bi-conducting plug connector, and whenever the tri-conducting socket connector is mated with the bi-conducting plug connector, the center pin of said bi-conducting plug connector is received in the center receptacle, the first and second socket contact surfaces are positioned against the outer cylindrical plug surface of said bi-conducting plug connector, and the first and second outer socket contacts are electrically connected to each other via said outer cylindrical plug surface.

* * * * *